US006661314B2

(12) United States Patent
Kundu

(10) Patent No.: US 6,661,314 B2
(45) Date of Patent: Dec. 9, 2003

(54) DIELECTRIC BAND PASS FILTER HAVING AN EVANESCENT WAVEGUIDE

(75) Inventor: Arun Chandra Kundu, Tokyo (JP)

(73) Assignee: TDK Corporation, Tokyo (JP)

( * ) Notice: Subject to any disclaimer, the term of this patent is extended or adjusted under 35 U.S.C. 154(b) by 49 days.

(21) Appl. No.: 10/000,602

(22) Filed: Oct. 23, 2001

(65) Prior Publication Data

US 2002/0070823 A1 Jun. 13, 2002

(30) Foreign Application Priority Data

Dec. 8, 2000 (JP) ..... 2000-374859

(51) Int. Cl.[7] ..... H01P 1/20; H01P 1/219

(52) U.S. Cl. ..... 333/210; 333/202

(58) Field of Search ..... 333/202, 219, 333/208, 210

(56) References Cited

U.S. PATENT DOCUMENTS

| | | | | |
|---|---|---|---|---|
| 5,629,656 A | | 5/1997 | Tada et al. | 333/202 |
| 6,154,106 A | * | 11/2000 | De Lillo | 333/210 |

FOREIGN PATENT DOCUMENTS

| | | |
|---|---|---|
| EP | 0 855 757 A2 | 7/1998 |
| EP | 0 933 831 A1 | 8/1999 |
| JP | 2000-068711 | 3/2000 |
| JP | 3067575 | 5/2000 |
| JP | 2000-151209 | 5/2000 |
| JP | 2000-165104 | 6/2000 |
| JP | 2000-165106 | 6/2000 |
| JP | 2000-183616 | 6/2000 |

OTHER PUBLICATIONS

Arun Chandra Kundu and Kenji Endou, "TEM–Mode Planar Dielectric Waveguide Resonator BPF for W–CDMA", 2000 IEEE MTT–S Digest, pp. 191–194, Jun. 2000.

Yoshihiro Konishi, "Novel Dielectric Waveguide Component—Microwave Applications of New Ceramic Materials", Proceedings of the IEEE, vol. 79, No. 6 pp. 726–740, Jun. 1991.

George L. Matthaei, Leo Young and E.M.T. Jones, "Microwave Filters, Impedance–Matching Networks, and Coupling Structures", Artech House 1980.

* cited by examiner

*Primary Examiner*—Robert Pascal
*Assistant Examiner*—Stephen E. Jones
(74) *Attorney, Agent, or Firm*—Brown Raysman Millstein Felder & Steiner LLP

(57) ABSTRACT

A highly compact band pass filter that has excellent mechanical strength is disclosed. A band pass filter according to the present invention employs a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on the surfaces of the dielectric block. The first portion of the dielectric block and the metal plates formed thereon are enabled to act as an evanescent waveguide. The second portion of the dielectric block and the metal plates formed thereon are enabled to act as a first resonator. The third portion of the dielectric block and the metal plates formed thereon are enabled to act as a second resonator. The metal plates include a capacitive stub formed on a first surface of the dielectric block which is substantially perpendicular to the cross-sections.

17 Claims, 21 Drawing Sheets

DIELECTRIC BAND PASS FILTER HAVING AN EVANESCENT WAVEGUIDE

BACKGROUND OF THE INVENTION

The present invention relates to a band pass filter, and particularly, to a highly compact band pass filter that has excellent mechanical strength.

DESCRIPTION OF THE PRIOR ART

In recent years, marked advances in miniaturization of communication terminals, typically mobile phones, has been achieved thanks to miniaturization of the various components incorporated therein. One of the most important components incorporated in a communication terminal is a filter component.

As one type of filter component, Japanese Patent Laid Open No. 2000-68711 and Japanese Patent Laid Open No. 2000-183616, for example, teach band pass filters comprising a dielectric block formed with a plurality of holes whose inner walls are coated with metal plates. As another type of a filter component, band pass filters constituted by forming metal plates on irregular surfaces of a dielectric block are described in "Novel Dielectric Waveguide Components—Microwave Applications of New Ceramic Materials (PROCEEDINGS OF THE IEEE, VOL.79, NO.6, JUNE 1991), p734, FIG. 31."

As a need continues to be felt for still further miniaturization of communication terminals such as mobile phones, further miniaturization of filter components, e.g., band pass filters, incorporated therein is also required.

The mechanical strength of the above-mentioned types of filter components is, however, low because holes are formed in, or irregularities are formed on, the dielectric block constituting the main body. Miniaturization of the filter component is therefore impossible. Specifically, in the former type of filter component having holes formed in a dielectric block, mechanical strength of the dielectric block is low around the holes and in the latter type of filter component having irregularities formed on the surface of a dielectric block, mechanical strength is low around the recesses. Therefore, miniaturization of the filter component must be limited to ensure the mechanical strength at such portions.

Thus, in the prior art it is difficult to miniaturize filter components while ensuring sufficient mechanical strength. Therefore, a compact band pass filter that has excellent mechanical strength is desired.

SUMMARY OF THE INVENTION

It is therefore an object of the present invention to provide a compact band pass filter having excellent mechanical strength.

The above and other objects of the present invention can be accomplished by a band pass filter comprising a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on the surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates including a capacitive stub formed on a first surface of the dielectric block which is substantially perpendicular to the cross-sections.

According to this aspect of the present invention, a filter function can be obtained even using a rectangular prismatic dielectric block because a desired coupling constant can be produced between the first and second resonators by the capacitive stub formed on the first surface of the dielectric block. Since the band pass filter according to the present invention is constituted of a rectangular prismatic dielectric block, the mechanical strength is extremely high. Thus, even if the overall size of the band pass filter is reduced, sufficient mechanical strength can be ensured.

In a preferred aspect of the present invention, the capacitive stub is formed on at least surfaces of the second and third portions of the dielectric block.

In a further preferred aspect of the present invention, the capacitive stub is further formed on a surface of the first portion of the dielectric block to form a continuous and integral capacitive stub on the surfaces of the first to third portions of the dielectric block.

In a further preferred aspect of the present invention, a portion of the capacitive stub formed on the surface of the second portion of the dielectric block and another portion of the capacitive stub formed on the surface of the third portion of the dielectric block have the same dimensions.

In a further preferred aspect of the present invention, the metal plates further include a first exciting electrode formed on a second surface of the dielectric block which is substantially parallel to the cross-sections and a second exciting electrode formed on a third surface of the dielectric block which is substantially parallel to the cross-sections.

In a further preferred aspect of the present invention, the second and third portions of the dielectric block have the same dimensions.

The above and other objects of the present invention can be also accomplished by a band pass filter comprising:

- a first flat resonator and a second flat resonator each having top and bottom surfaces on which metal plates are formed, a shorting surface electrically short-circuiting the metal plates formed on the top and bottom surfaces, a first open surface opposite the shorting surface, a second open surface perpendicular to the shorting surface, and a third open surface opposite the second open surface;
- an evanescent waveguide provided between the first and second flat resonators such that the evanescent waveguide is in contact with the entire second open surfaces of the first and second flat resonators;
- a first capacitive stub formed on the first open surface of the first flat resonator;
- a second capacitive stub formed on the first open surface of the second flat resonator;
- a first exciting electrode formed on the third open surface of the first flat resonator; and
- a second exciting electrode formed on the third open surface of the second flat resonator.

According to this aspect of the present invention, a band pass filter having no surface irregularities can be obtained because a desired coupling constant can be produced between the first and second flat resonators by the first and second capacitive stubs. Since the band pass filter according to the present invention has no surface irregularities, its mechanical strength is extremely high. Thus, even if the overall size of the band pass filter is reduced, sufficient mechanical strength can be ensured.

In a preferred aspect of the present invention, the band pass filter is substantially a rectangular prism in overall shape.

In a further preferred aspect of the present invention, the first and second flat resonators have the same dimensions.

In a further preferred aspect of the present invention, the first open surfaces of the first and second flat resonators are coplanar.

In a further preferred aspect of the present invention, the metal plates formed on the bottom surfaces of the first and second flat resonators are short-circuited by a metal plate formed on a bottom surface of the evanescent waveguide.

In a further preferred aspect of the present invention, the first and second capacitive stubs are short-circuited by a metal plate formed on a side surface of the evanescent waveguide.

In a further preferred aspect of the present invention, the first capacitive stub is connected to the metal plate formed on the bottom surface of the first flat resonator and the second capacitive stub is connected to the metal plate formed on the bottom surface of the second flat resonator.

In a further preferred aspect of the present invention, the first exciting electrode is formed on the third open surface of the first flat resonator at a portion adjacent to the first open surface of the first flat resonator, the second exciting electrode is formed on the third open surface of the second flat resonator at a portion adjacent to the first open surface of the second flat resonator, the first exciting electrode is prevented from being in contact with the metal plates formed on the top and bottom surfaces of the first flat resonator, and the second exciting electrode is prevented from being in contact with the metal plates formed on the top and bottom surfaces of the second flat resonator.

In a further preferred aspect of the present invention, the first exciting electrode is formed on the third open surface of the first flat resonator at a portion adjacent to the shorting surface of the first flat resonator, the second exciting electrode is formed on the third open surface of the second flat resonator at a portion adjacent to the shorting surface of the second flat resonator, the first exciting electrode is prevented from being in contact with the metal plate formed on the bottom surface of the first flat resonator and is connected to the metal plate formed on the top surface of the first flat resonator, and the second exciting electrode is prevented from being in contact with the metal plate formed on the bottom surface of the second flat resonator and is connected to the metal plate formed on the top surface of the second flat resonator.

The above and other objects of the present invention can be also accomplished by a band pass filter comprising:

a first flat resonator and a second flat resonator each having top and bottom surfaces on which metal plates are formed, a shorting surface electrically short-circuiting the metal plates formed on the top and bottom surfaces, a first open surface opposite the shorting surface, a second open surface perpendicular to the shorting surface, and a third open surface opposite the second open surface;

an evanescent waveguide provided between the first and second flat resonators such that the evanescent waveguide is in contact with the entire second open surfaces of the first and second flat resonators;

a first exciting electrode formed on the third open surface of the first flat resonator; and a second exciting electrode formed on the third open surface of the second flat resonator, whereby a first resonation circuit is established between the first exciting electrode and the metal plates, a second resonation circuit is established between the second exciting electrode and the metal plates, and a coupling circuit is established between the first and second resonation circuits, the band pass filter further comprising means for providing an additional capacitance in parallel with the first resonation circuit and another additional capacitance in parallel with the second resonation circuit.

In a preferred aspect of the present invention, the band pass filter is substantially a rectangular prism in overall shape.

DESCRIPTION OF THE PREFERRED EMBODIMENTS

Preferred embodiments of the present invention will now be explained with reference to the drawings.

Figure 1:
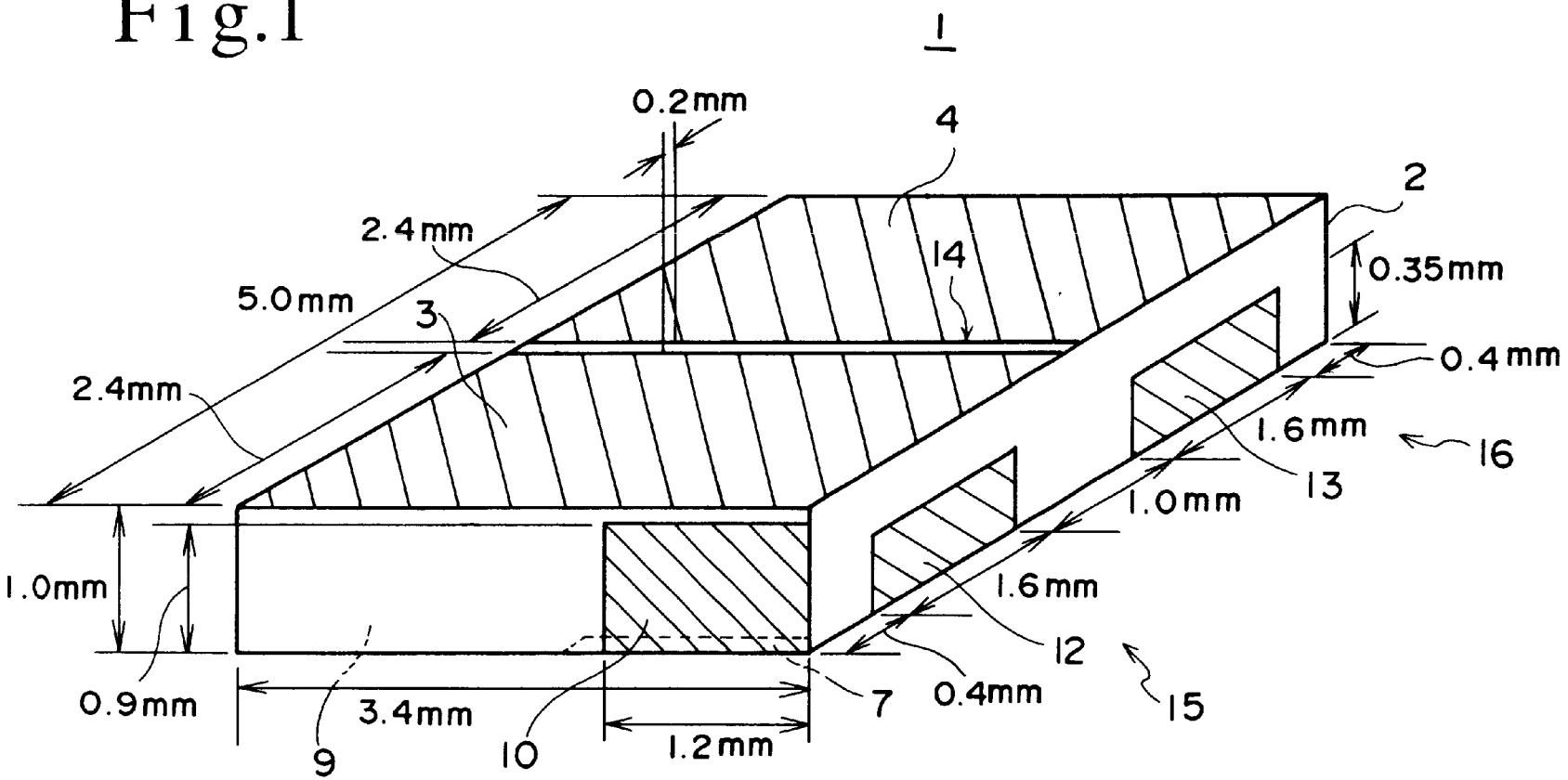
FIG. 1 is a schematic perspective view from one side showing a band pass filter 1 that is a preferred embodiment of the present invention.
Figure 2:
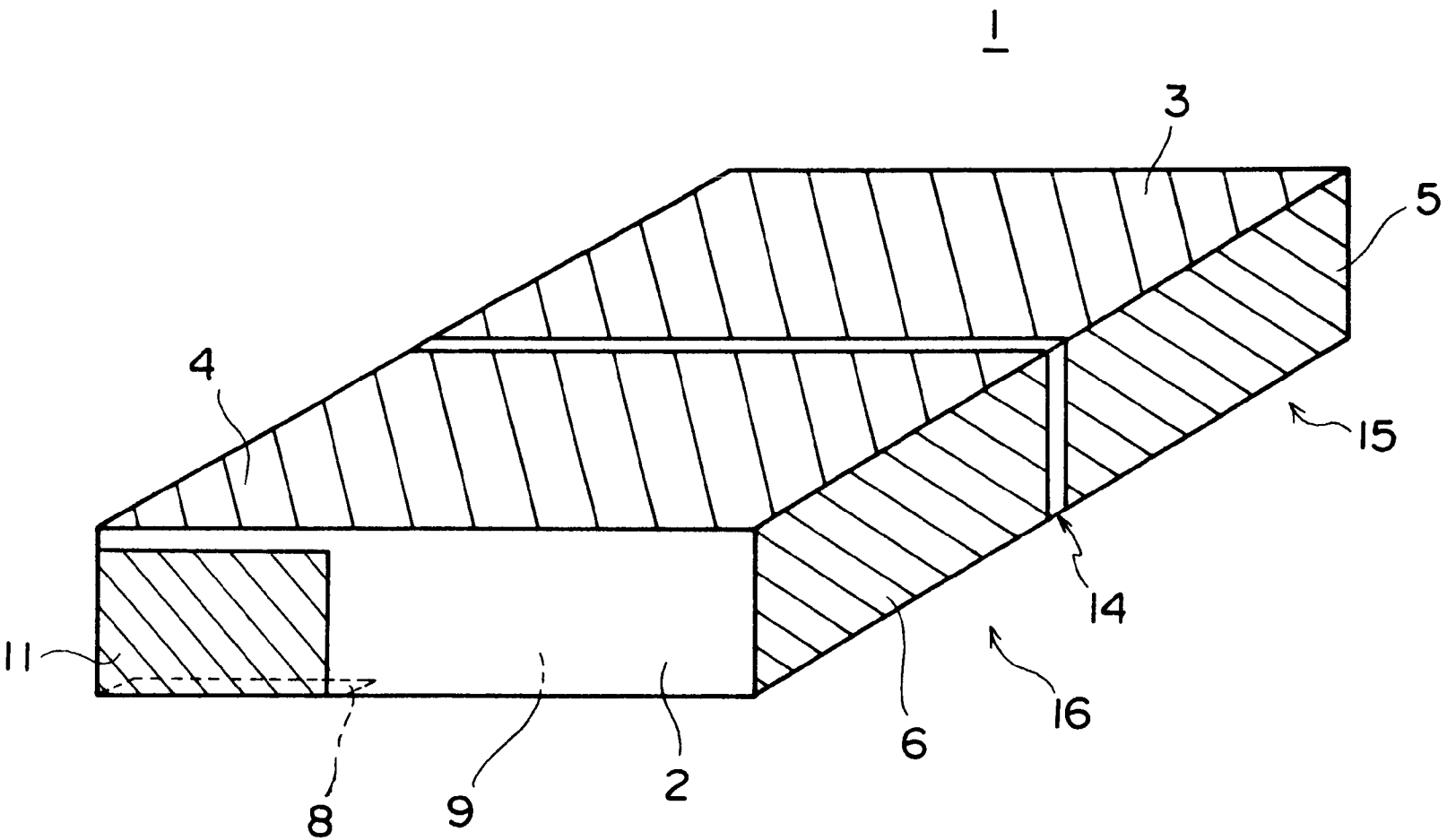
FIG. 2 is a schematic perspective view from the opposite side showing the band pass filter of FIG. 1.

As shown in FIGS. 1 and 2, a band pass filter 1 that is a preferred embodiment of the present invention is constituted of a dielectric block 2 and various metal plates formed on the surface thereof. The dielectric block 2 is made of dielectric material whose dielectric constant $\epsilon\Gamma$ is relatively high, i.e., $\epsilon\Gamma=93$, and has the shape of a rectangular prism whose length, width, and thickness are 5.0 mm, 3.4 mm, and 1.0 mm. That is, the dielectric block 2 has no holes or surface irregularities.

Further, the dielectric block 2 is composed of a first portion lying between a first cross-section and a second cross-section parallel to the first cross-section and second and third portions divided by the first portion. It is worth noting that this does not mean that the dielectric block 2 is a combination of the first to third portions of physically different components. The dielectric block 2 constitutes a single dielectric unit, i.e., the first to third portions are names used solely for convenience of description.

The first portion whose length, width, and thickness are 0.2 mm, 3.4 mm, and 1.0 mm, is located at the center of the rectangular prismatic dielectric block 2. The second and third portions of the dielectric block 2 are symmetrically located relative to the first portion. Each measures 2.4 mm, 3.4 mm, and 1.0 mm in length, width and thickness. Directions defining the "length," "width," and "thickness" of the first to third portions are the same as the directions defining the "length," "width," and "thickness" of the dielectric block 2.

The dielectric block 2 has a top surface, a bottom surface, and four side surfaces. Among the four side surfaces of the dielectric block 2, the end surface of the second portion is defined as a "first side surface," end surface of the third portion is defined as a "second side surface," and the remaining surfaces are defined as a "third side surface" and a "fourth side surface." Therefore, both the top and bottom surfaces measure 5.0 mm (length)×3.4 mm (width), both the first and second side surfaces measure 1.0 mm (thickness)× 3.4 mm (width), and both the third and fourth side surfaces measure 5.0 mm (length)×1.0 mm (thickness).

As shown in FIGS. 1 and 2, metal plates 3 and 4 are formed on, among the top surface of the dielectric block 2, entire surfaces corresponding to the second and third portions, respectively. Metal plates 5 and 6 are formed on parts of the third surface of the dielectric block 2 corresponding to the entire surfaces of the second and third portions, respectively. A metal plate 9 is formed on the bottom surface of the dielectric block 2 except at clearance portions 7 and 8. These metal plates 3, 4, 5, 6, and 9 are short-circuited with one another and grounded.

As shown in FIG. 1, an exciting electrode 10 whose height and width are 0.9 mm and 1.2 mm is formed on the first side surface of the dielectric block 2 where the clearance portion 7 prevents the exciting electrode 10 from being in contact with the metal plate 9 formed on the bottom surface. Similarly, as shown in FIG. 2, an exciting electrode 11 whose height and width are 0.9 mm and 1.2 mm is formed on the second side surface of the dielectric block 2 where the clearance portion 8 prevents the exciting electrode 11 from being in contact with the metal plate 9 formed on the bottom surface. One of the exciting electrodes 10 and 11 is used as an input electrode, and the other is used as an output electrode.

As shown in FIG. 1, a first capacitive stub 12 whose height and width are 0.35 mm and 1.6 mm is formed on the fourth side surface of the dielectric block 2 corresponding to the second portion and a second capacitive stub 13 whose height and width are 0.35 mm and 1.6 mm is formed on the fourth side surface of the dielectric block 2 corresponding to the third portion. The first and second capacitive stubs 12 and 13 are connected to the metal plate 9 formed on the bottom surface of the dielectric block. The direction defining the "width" of the first and second capacitive stubs 12 and 13 is coincident with the direction defining the "length" of the dielectric block 2.

The metal plates 3, 4, 5, 6, and 9, the exciting electrodes 10 and 11, and the first and second capacitive stubs 12 and 13 are made of silver. However, the present invention is not limited to using silver and other kinds of metal can be used instead. It is preferable to use a screen printing method to form them on the surfaces of the dielectric block 2.

No metal plate or electrode is formed on the remaining surfaces of the dielectric block 2, which therefore constitute open ends.

According to the above described structure, the first portion of the dielectric block 2 and the metal plate formed thereon act as an evanescent waveguide 14, the second portion of the dielectric block 2 and the metal plate formed thereon act as a first resonator 15, and the third portion of the dielectric block 2 and the metal plate formed thereon act as a second resonator 16. The evanescent waveguide 14 is an E-mode waveguide, and each of the first and second resonators 15 and 16 is a quarter-wave ($\lambda/4$) dielectric resonator.

The principle of the quarter-wave ($\lambda/4$) dielectric resonators constituted by the first resonator 15 and the second resonator 16 will now be explained.

Figure 3:
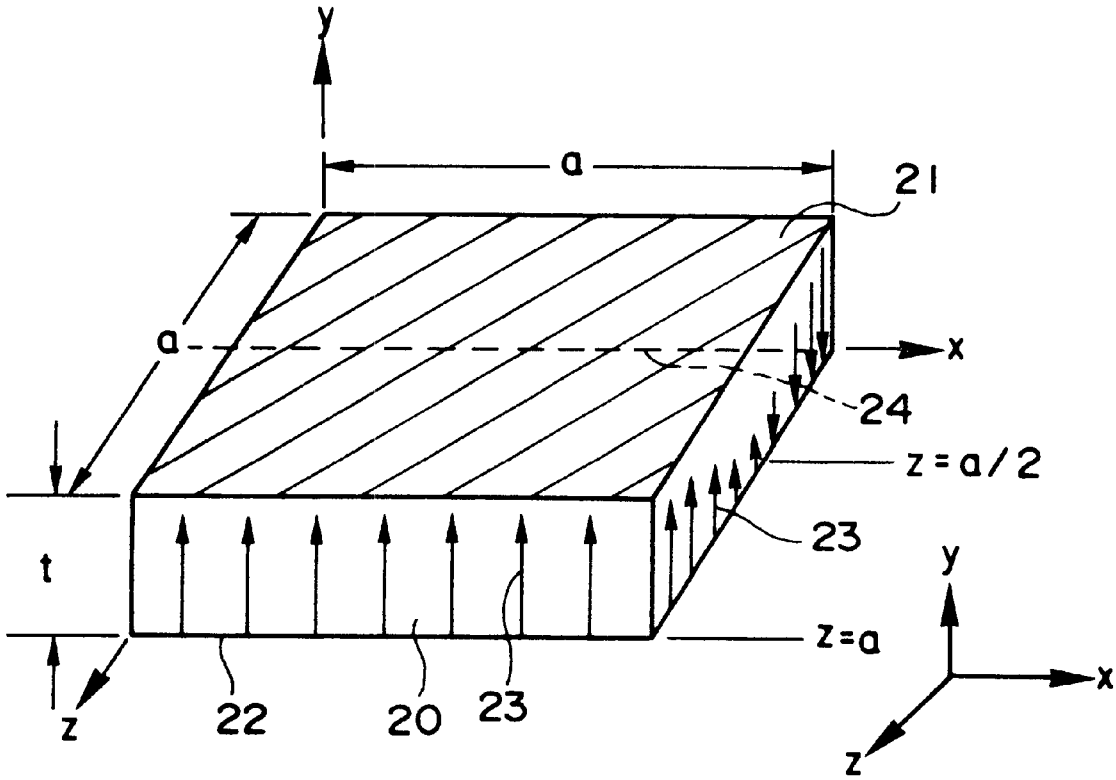
FIG. 3 is a schematic perspective view showing an ordinary TEM-mode half-wave ($\lambda/2$) dielectric resonator.

FIG. 3 is a schematic perspective view showing an ordinary TEM-mode half-wave ($\lambda/2$) dielectric resonator.

As shown in FIG. 3, the ordinary half-wave ($\lambda/2$) dielectric resonator is constituted of a dielectric block 20, a metal plate 21 formed on the upper surface of the dielectric block 20, and a metal plate 22 formed on the lower surface of the dielectric block 20. The metal plate 21 formed on the upper surface of the dielectric block 20 is electrically floated whereas the metal plate 22 formed on the lower surface of the dielectric block 20 is grounded. All of the four side surfaces of the dielectric block 20 are open to the air. In FIG. 3, the length and width of the dielectric block 20 are indicated by a and t.

For propagation of the dominant TEM-mode along the z direction of this half-wave ($\lambda/2$) dielectric resonator, if electric field is negative maximum at z=0 plan, then it should be positive maximum at z=a plan as indicated by the arrow 23 in this Figure. Definitely there should be minimum (zero) electric field at z=a/2 plan, which is the symmetry plan 24 of the resonator.

Cutting such a half-wave ($\lambda/2$) dielectric resonator along the symmetry plan 24, two quarter-wave ($\lambda/4$) dielectric resonators can be obtained. In this quarter-wave (λ/4) dielectric resonator, a plan z=a/2 acts as a perfect electric conductor (PEC).

Figure 4:
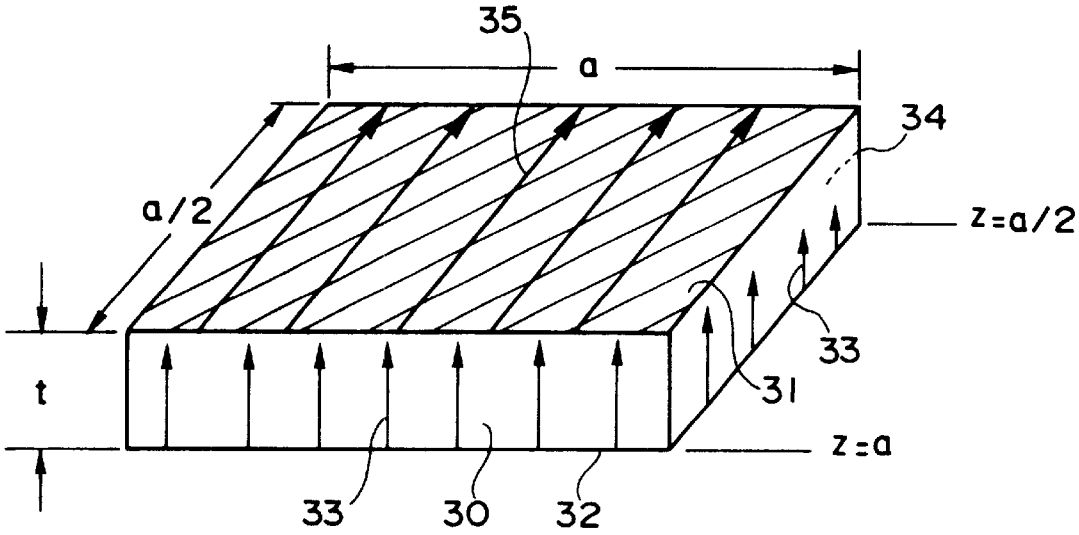
FIG. 4 is a schematic perspective view showing an ordinary quarter-wave ($\lambda/4$) dielectric resonator.

FIG. 4 is a schematic perspective view showing the quarter-wave (λ/4) dielectric resonator obtained by above described method.

As shown in FIG. 4, the quarter-wave (λ/4) dielectric resonator is constituted of a dielectric block 30, a metal plate 31 formed on the upper surface of the dielectric block 30, a metal plate 32 formed on the lower surface of the dielectric block 30, and a metal plate 34 formed on one of the side surfaces of the dielectric block 30. The remaining three side surfaces of the dielectric block 30 are open to the air. The metal plate 32 formed on the lower surface of the dielectric block 30 is grounded. The metal plate 34 formed on one of the side surfaces of the dielectric block 30 corresponds to the perfect electric conductor (PEC) of the half-wave (λ/2) dielectric resonator to short-circuit the metal plate 31 and the metal plate 32. In FIG. 4, arrows 33 indicate electric field, and arrows 35 indicate current flow.

Ideally, the quarter-wave (λ/4) dielectric resonator shown in FIG. 4 and the half-wave (λ/2) dielectric resonator shown in FIG. 3 should have the same resonant frequency. If a material having a relatively high dielectric constant is used for the dielectric block 30, electromagnetic field confinement inside the resonator is adequately strong. Moreover, the distribution of the electromagnetic field of the quarter-wave (λ/4) dielectric resonator becomes substantially the same as that of the half-wave (λ/2) dielectric resonator. As shown in FIGS. 3 and 4, the volume of the quarter-wave (λ/4) dielectric resonator is half the volume of the half-wave (λ/2) dielectric resonator. As a result, the total energy of the quarter-wave (λ/4) dielectric resonator is also half the total energy of the half-wave (λ/2) dielectric resonator. However, the unloaded quality factor ($Q_0$) of the quarter-wave (λ/4) dielectric resonator remain almost same that of the half-wave (λ/2) dielectric resonator because the energy loss of the quarter-wave (λ/4) dielectric resonator decreases to around 50% that of the half-wave (λ/2) dielectric resonator. The quarter-wave (λ/4) dielectric resonator therefore enables miniaturization without substantially changing the resonant frequency and the unloaded quality factor ($Q_0$).

Figure 5:
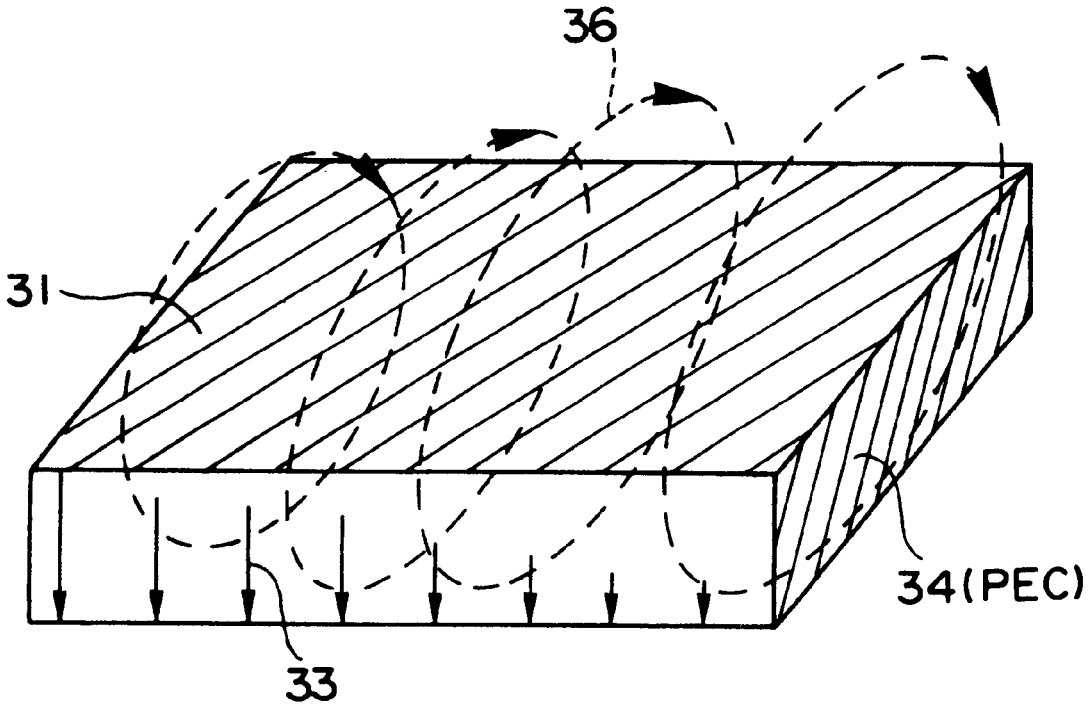
FIG. 5 is a schematic diagram for explaining an electric field and a magnetic field generated by a quarter-wave ($\lambda/4$) dielectric resonator.

FIG. 5 is a schematic diagram for explaining the electric field and the magnetic field generated by the quarter-wave (λ/4) dielectric resonator.

As shown in FIG. 5, the magnetic field 36 of the quarter-wave (λ/4) dielectric resonator is maximum throughout the metal plate 34 formed on one of the side surfaces of the dielectric block 30. By linking the metal plate 34, the magnetic field 36 causes the additional series inductance to resonator equivalent circuit. Thus, the resonant frequency of the quarter-wave (λ/4) dielectric resonator therefore becomes slightly lower than that of the half-wave (λ/2) dielectric resonator.

In this type of quarter-wave (λ/4) dielectric resonator, the unloaded quality factor ($Q_0$) depends on the thickness and the length of the dielectric block. Specifically, the unloaded quality factor ($Q_0$) of the quarter-wave (λ/4) dielectric resonator increases in proportion to the thickness of the dielectric block in a first thickness region of the dielectric block smaller than a predetermined thickness and decreases in proportion to the thickness of the dielectric block in a second thickness region of the dielectric block greater than the predetermined thickness. Further, the unloaded quality factor ($Q_0$) of the quarter-wave (λ/4) dielectric resonator increases in proportion to the length of the dielectric block in a first length region of the dielectric block smaller than a predetermined length and becomes substantially constant in a second length region of the dielectric block greater than the predetermined length. A quarter-wave (λ/4) dielectric resonator having the desired unloaded quality factor ($Q_0$) can therefore be obtained by optimizing the thickness and the length of the dielectric block constituting the quarter-wave (λ/4) dielectric resonator.

Further, in this type of quarter-wave (λ/4) dielectric resonator, the resonant frequency mainly depends on the width of the dielectric block but has very little dependence upon thickness and length of the resonator. Specifically, the resonant frequency increases with shorter width of the dielectric block. A quarter-wave (λ/4) dielectric resonator having the desired resonant frequency can therefore be obtained by optimizing the width of the dielectric block constituting the quarter-wave (λ/4) dielectric resonator.

The band pass filter 1 of this embodiment is constituted of two quarter-wave (λ/4) dielectric resonators, whose operating principle was explained in the foregoing, and an evanescent waveguide 14 which acts as an E-mode waveguide disposed therebetween.

Figure 6:
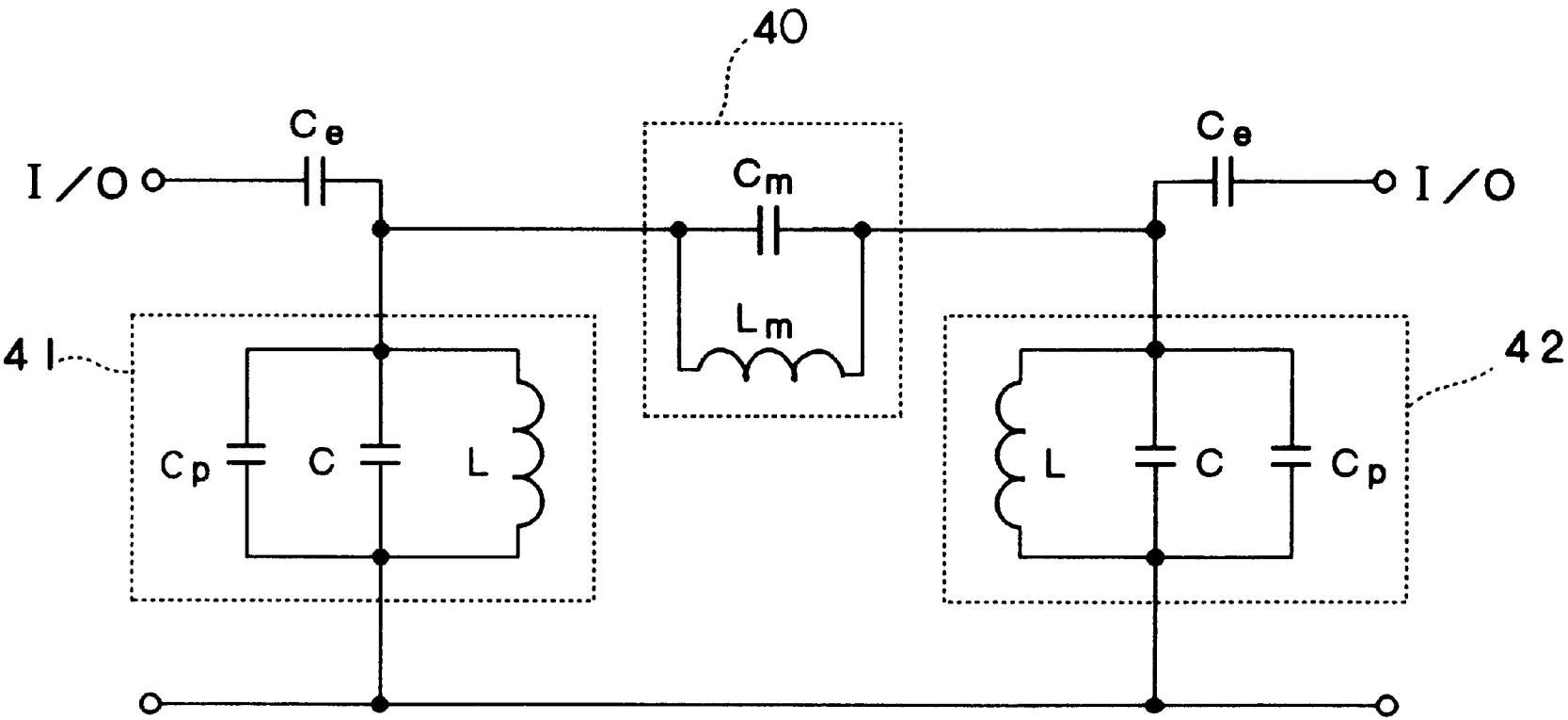
FIG. 6 is an equivalent circuit diagram of the band pass filter 1 shown in FIGS. 1 and 2.

FIG. 6 is an equivalent circuit diagram of the band pass filter 1 shown in FIGS. 1 and 2.

In this Figure, the evanescent waveguide 14 is represented by a L-C parallel circuit 40, and the first resonator 15 and the second resonator 16 are represented by two L-C parallel circuits 41 and 42, respectively. Capacitances Cp of the L-C parallel circuits 41 and 42 are produced by the first and second capacitive stubs 12 and 13. The exciting electrodes 10 and 11 are represented by two capacitances Ce.

Figure 7:
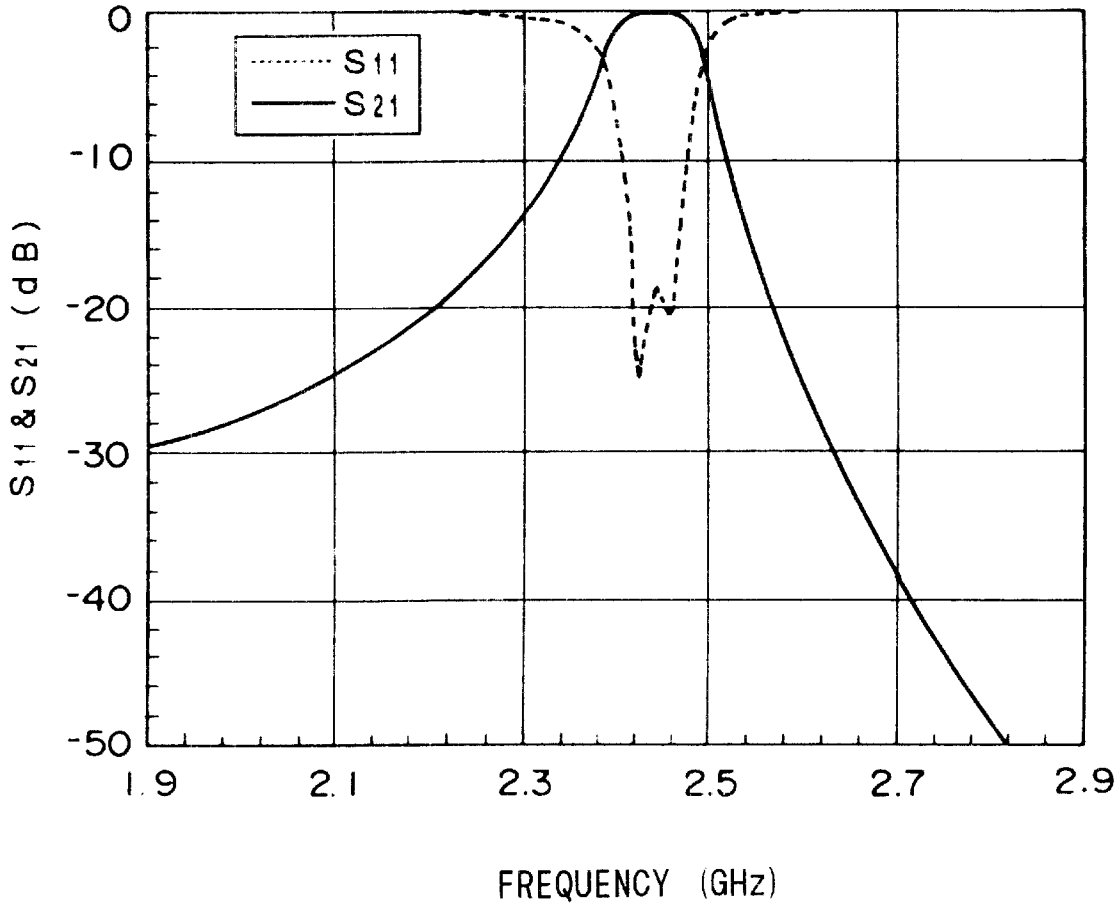
FIG. 7 is graph showing the frequency characteristic curve of the band pass filter 1 shown in FIGS. 1 and 2.

FIG. 7 is a graph showing the frequency characteristic curve of the band pass filter 1 shown in FIGS. 1 and 2.

In this Figure, S11 represents a reflection coefficient, and S21 represents a transmission coefficient. As shown in FIG. 7, the resonant frequency of the band pass filter 1 is approximately 2.45 GHz and its 3-dB band width is approximately 120 MHz.

The function of the first and second capacitive stubs 12 and 13 of the band pass filter 1 will be explained.

To explain the function of the first and second capacitive stubs 12 and 13, a model in which first and second capacitive stubs 12 and 13 are eliminated from the band pass filter 1 will be explained first.

Figure 8:
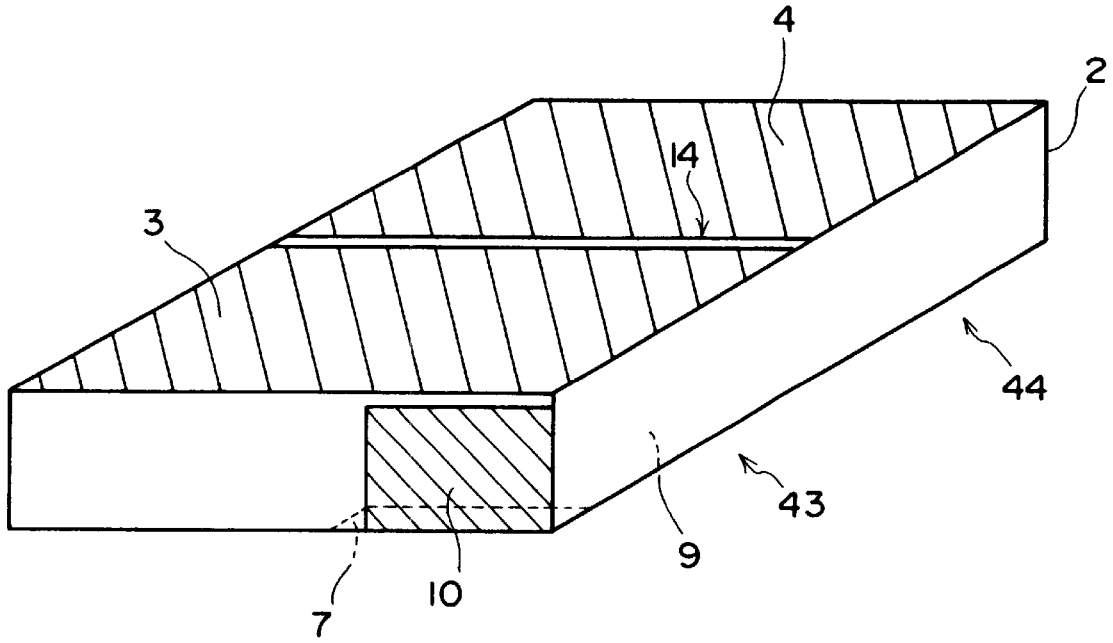
FIG. 8 is a schematic perspective view from one side showing a model in which first and second capacitive stubs 12 and 13 are eliminated from the band pass filter 1 shown in FIGS. 1 and 2.
Figure 9:
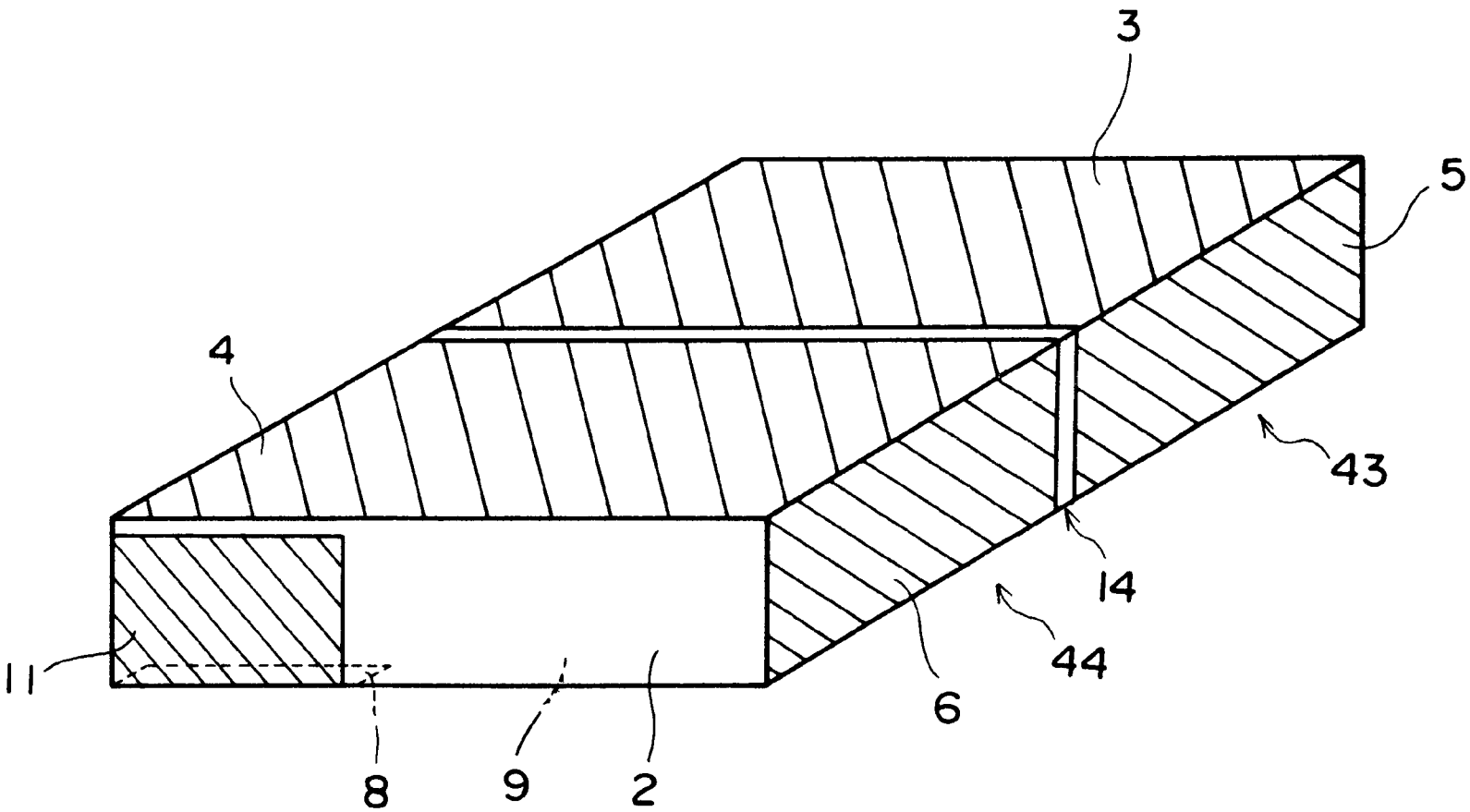
FIG. 9 is a schematic perspective view from the opposite side showing the model of FIG. 8.

FIG. 8 is a schematic perspective view from one side showing the model in which the first and second capacitive stubs 12 and 13 are eliminated from the band pass filter 1 shown in FIGS. 1 and 2. FIG. 9 is a schematic perspective view from the opposite side showing the model of FIG. 8.

This model is constituted of the evanescent waveguide 14, a first resonator 43, and a second resonator 44. Each of the first and second resonators 43 and 44 is a quarter-wave (λ/4) dielectric resonator.

Figure 10:
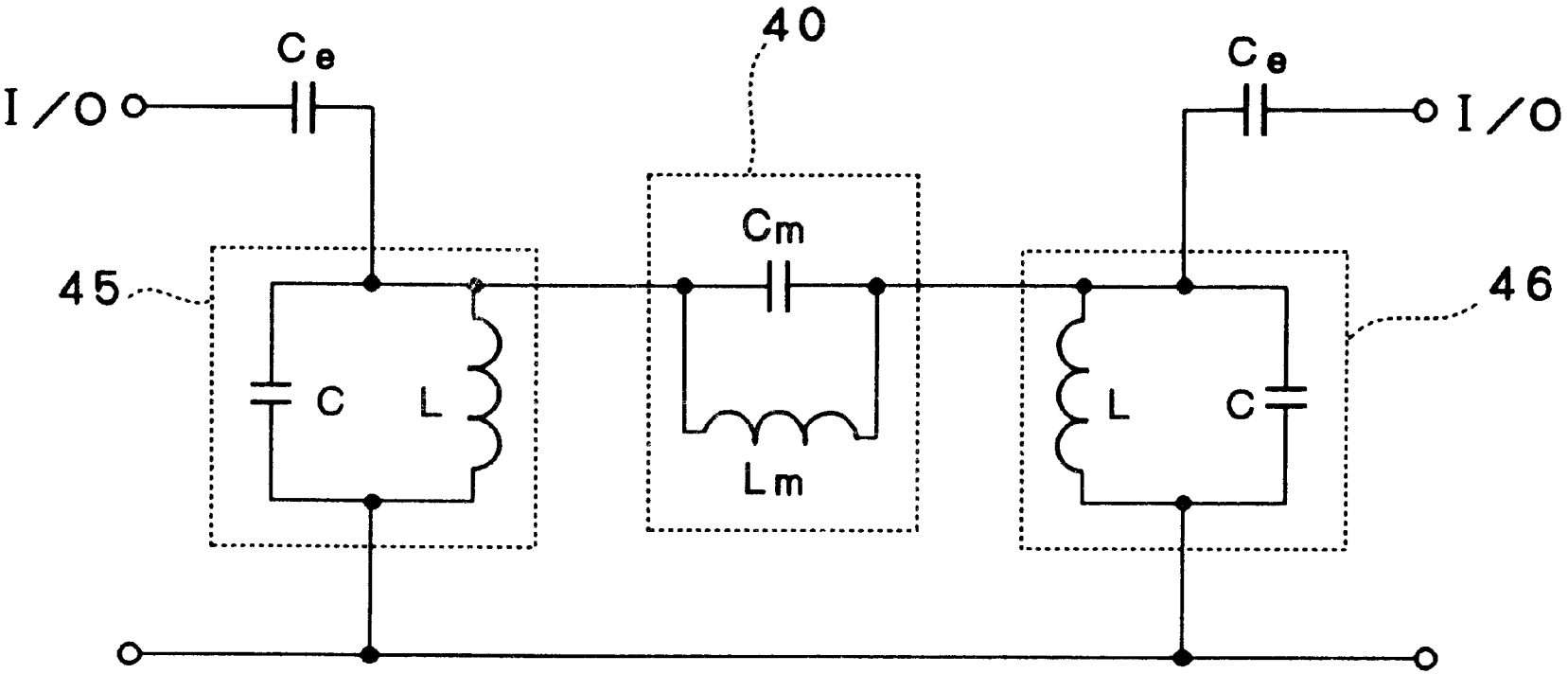
FIG. 10 is an equivalent circuit diagram of the model shown in FIGS. 8 and 9.

FIG. 10 is an equivalent circuit diagram of the model shown in FIGS. 8 and 9.

In this Figure, the evanescent waveguide 14 is represented by the L-C parallel circuit 40, and the first resonator 43 and the second resonator 44 are represented by two L-C parallel circuits 45 and 46, respectively. Unlike the L-C parallel circuits 41 and 42, the L-C parallel circuits 45 and 46 do not include capacitances Cp because the model does not employ the first and second capacitive stubs 12 and 13.

The coupling constant $k_{total}$ ascribed to the evanescent waveguide 14 can be represented by the following formula.

$$k_{total}=k_c+k_i$$

where $k_c$ represents the capacitive coupling constant and $k_i$ represents the inductive coupling constant. These constants can be represented by the following formulas.

$k_c$=(coupling capacitance between the resonators)/(capacitance of each resonator)

$k_i$=(coupling inductance between the resonators)/(inductance of each resonator)

In the model shown in FIGS. 8 and 9, therefore, the capacitive coupling constant $k_c$ is represented by Cm/C and the inductive coupling constant $k_i$ is represented by Lm/L. In this model, the coupling constant $k_{total}$ becomes zero because $$Cm/C=-Lm/L.$$

Therefore, the model in FIGS. 8 and 9 does not have a filter function.

As apparent from the foregoing, the filter function disappears when the first and second capacitive stubs 12 and 13 are eliminated from the band pass filter 1.

In contrast, in the band pass filter 1 of the preferred embodiment, since the capacitances Cp are added to the L-C parallel circuits 41 and 42 in parallel by the first and second capacitive stubs 12 and 13, the capacitive coupling constant $k_c$ is represented by Cm/(C+Cp) and the inductive coupling constant $k_i$ is represented by Lm/L. In this case, the coupling constant $k_{total}$ becomes other than zero because $$Cm/(C+Cp)\neq-Lm/L.$$

Thus, the band pass filter 1 of the preferred embodiment has desired filter function.

As apparent from the foregoing, the first and second capacitive stubs 12 and 13 function to provide a predetermined coupling constant $k_{total}$ between the first and second resonators 15 and 16.

Figure 11:
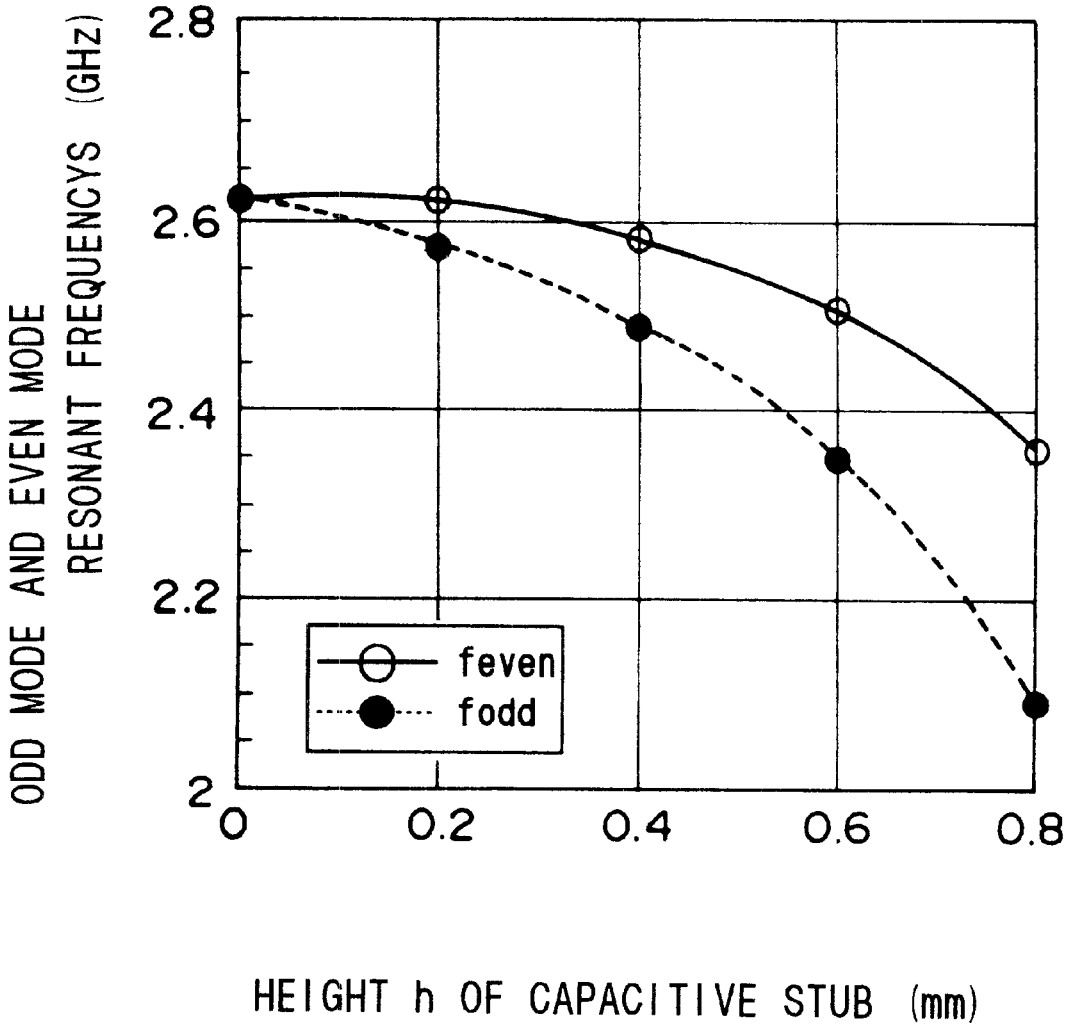
FIG. 11 is a graph showing the relationship between the heights h of the first and second capacitive stubs 12 and 13 and an even mode resonant frequency $f_{even}$ and an odd mode resonant frequency $f_{odd}$.

FIG. 11 is a graph showing the relationship between the heights h of the first and second capacitive stubs 12 and 13 and an even mode resonant frequency $f_{even}$ and an odd mode resonant frequency $f_{odd}$. The widths of both the first and second capacitive stubs 12 and 13 are fixed at 1.6 mm.

As shown in FIG. 11, both the even mode resonant frequency $f_{even}$ and the odd mode resonant frequency $f_{odd}$ decrease with increasing height h of the first and second capacitive stubs 12 and 13, whereas the even mode resonant frequency $f_{even}$ and the odd mode resonant frequency $f_{odd}$ are the same when the height h is 0 mm, i.e., without capacitive stubs. As is apparent from FIG. 11, because the odd mode resonant frequency $f_{odd}$ decreases more rapidly than the even mode resonant frequency $f_{even}$, the frequency difference between them increases with increasing height h of the first and second capacitive stubs 12 and 13. This means that the coupling constant $k_{total}$ increases with increasing height h of the first and second capacitive stubs 12 and 13.

Figure 12:
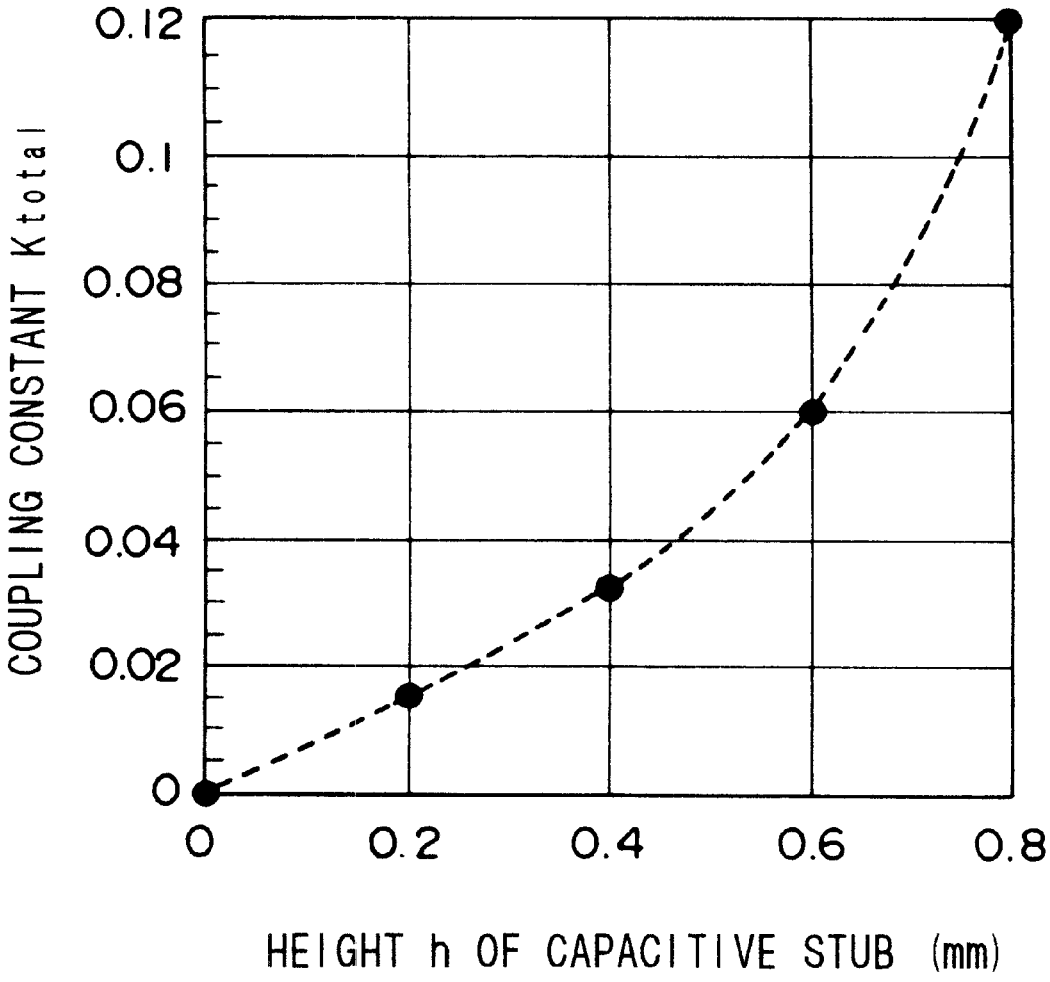
FIG. 12 is a graph showing the relationship between the heights h of the first and second capacitive stubs 12 and 13 and a coupling constant $k_{total}$.

FIG. 12 is a graph showing the relationship between the heights h of the first and second capacitive stubs 12 and 13 and a coupling constant $k_{total}$. The widths of both the first and second capacitive stubs 12 and 13 are fixed at 1.6 mm.

As is apparent from FIG. 12, the coupling constant $k_{total}$ exponentially increases with increasing height h of the first and second capacitive stubs 12 and 13. In the case where the height h of the first and second capacitive stubs 12 and 13 are set at 0.35 mm as in the band pass filter 1 of this embodiment, a coupling constant $k_{total}$ of approximately 0.034 can be obtained as shown in FIG. 12.

As described above, the first and second capacitive stubs 12 and 13 give the band pass filter 1 a filter function, and a desired coupling constant $k_{total}$ can be obtained by controlling their height h. Because the coupling constant $k_{total}$ also increases with increasing width of the first and second capacitive stubs 12 and 13, a desired coupling constant $k_{total}$ can be also obtained by controlling their width.

Figure 13:
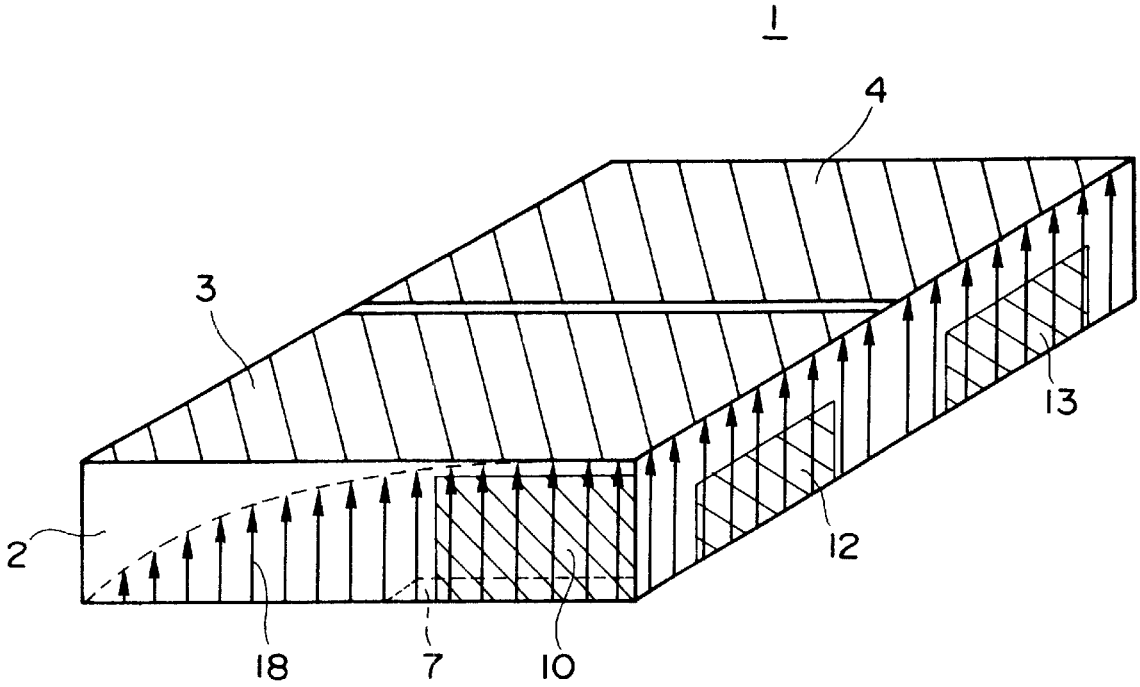
FIG. 13 is a schematic perspective view for explaining the relationship between an electric field generated by the band pass filter 1 shown in FIGS. 1 and 2 and the first and second capacitive stubs 12 and 13.

FIG. 13 is a schematic perspective view for explaining the relationship between an electric field generated by the band pass filter 1 shown in FIGS. 1 and 2 and the first and second capacitive stubs 12 and 13.

As is apparent from FIG. 13, the first and second capacitive stubs 12 and 13 are formed at the fourth side surface of the dielectric block 2 where the electric field 18 is the strongest. A radiation loss arising at the fourth side surface of the dielectric block 2 is therefore reduced. Further, the exciting electrode 10 (11) is formed at a region of the first (second) side surface of the dielectric block 2 where the electric field 18 is relatively strong. The widths and heights of the exciting electrodes 10 and 11 are 1.2 mm and 0.9 mm, as mentioned above. An external quality factor Q of 29 can therefore be obtained.

Because, as described above, the band pass filter 1 according to this embodiment is constituted of the rectangular prismatic dielectric block 2 having no holes or surface irregularities and the metal plates 3, 4, 5, 6, and 9, the exciting electrodes 10 and 11, and the first and second capacitive stubs 12 and 13 formed on the surfaces thereof, the mechanical strength is extremely high compared with conventional filters. Thus, even if the overall size of the band pass filter 1 is reduced, sufficient mechanical strength can be ensured.

Moreover, because the band pass filter 1 according to this embodiment can be fabricated by only coating various metal plates on the dielectric block 2, i.e., forming holes or inequalities is not necessary as in conventional filters, the fabrication cost thereof can be substantially reduced.

Another preferred embodiment of the present invention will now be explained.

Figure 14:
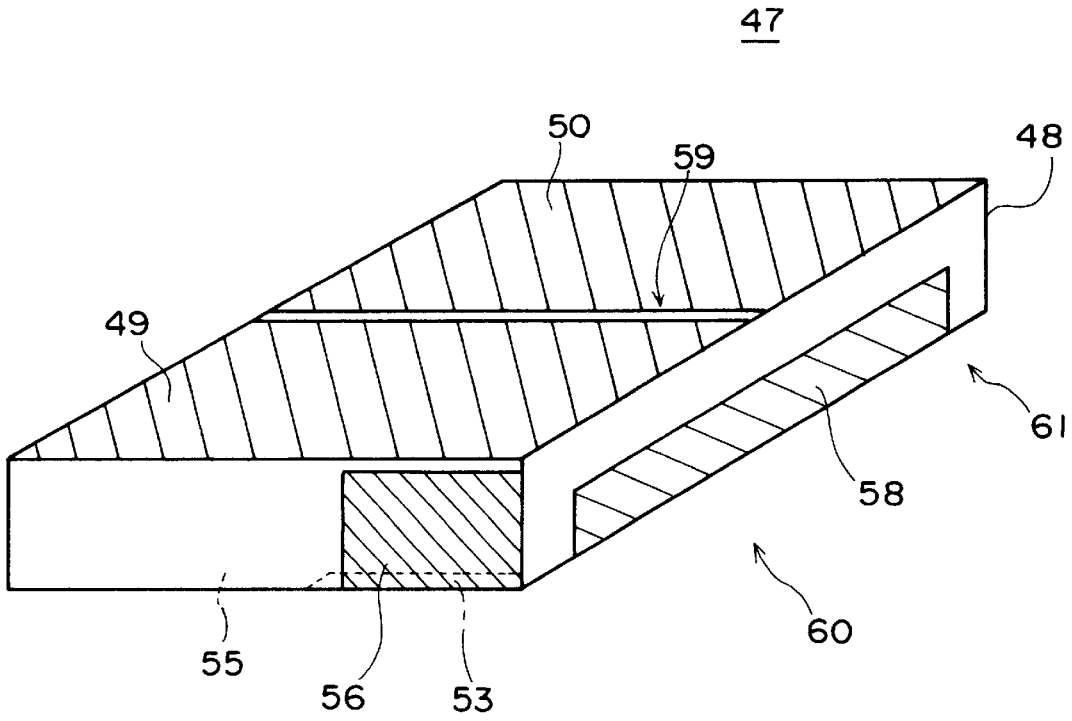
FIG. 14 is a schematic perspective view from one side showing a band pass filter 47 that is another preferred embodiment of the present invention.
Figure 15:
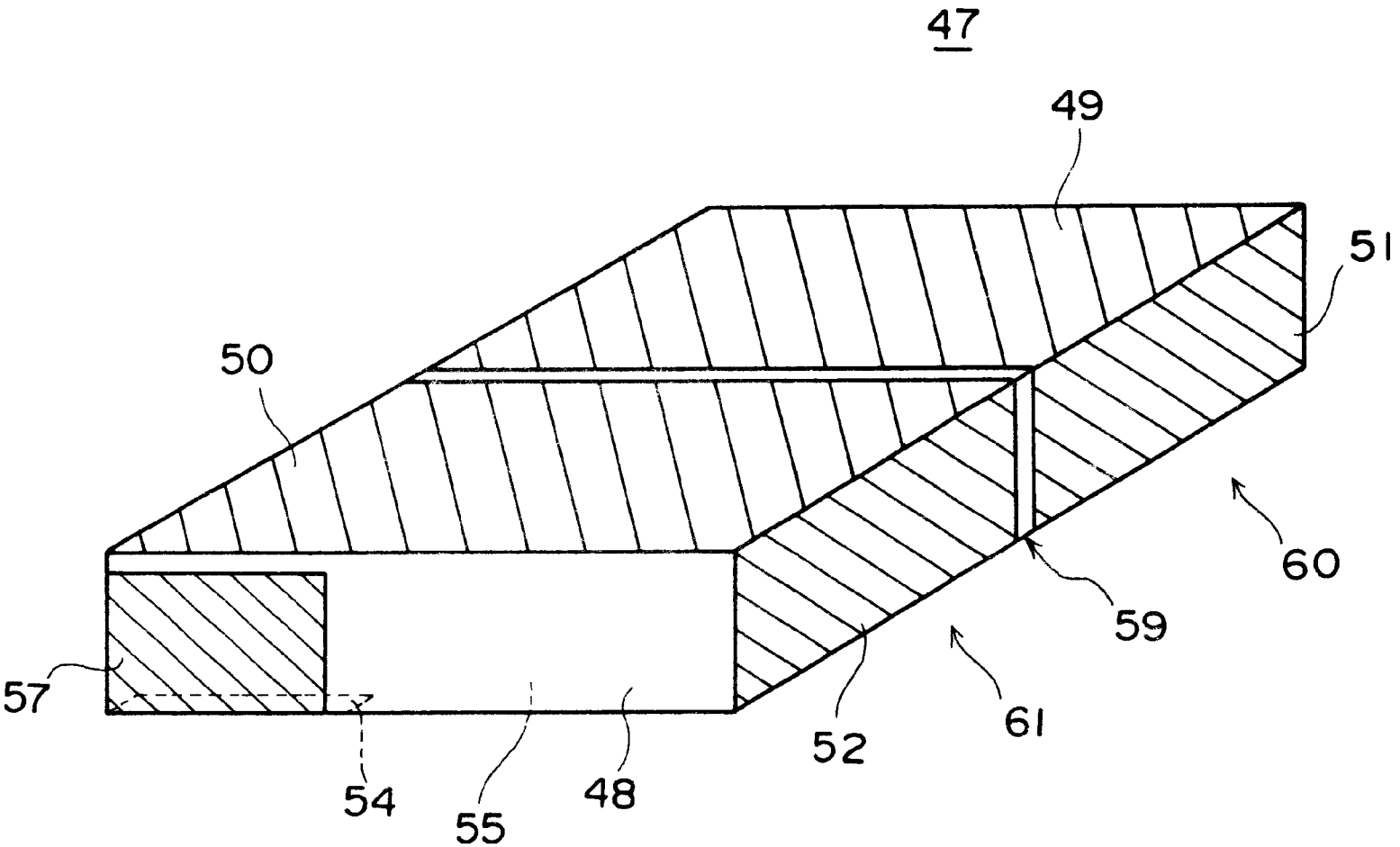
FIG. 15 is a schematic perspective view from the opposite side showing the band pass filter 47 of FIG. 14.

FIG. 14 is a schematic perspective view from one side showing a band pass filter 47 that is another preferred embodiment of the present invention. FIG. 15 is a schematic perspective view from the opposite side showing the band pass filter 47 of FIG. 14.

As shown in FIGS. 14 and 15, the structure of the band pass filter 47 that is another preferred embodiment is similar to that of the band pass filter 1 of the embodiment explained earlier, but the band pass filter 47 differs from the band pass filter 1 in that a capacitive stub is formed as a single unit.

Specifically, the band pass filter 47 that is another preferred embodiment is constituted of a regular prismatic dielectric block 48 whose dielectric constant $\epsilon\Gamma$ is 93, metal plates 49 and 50 formed on, of the top surface of the dielectric block 48, the entire surfaces corresponding to the second and third portions, respectively, metal plates 51 and 52 formed on, of the third surface of the dielectric block 48, the entire surfaces corresponding to the second and third portions, respectively, a metal plate 55 formed on the bottom surface of the dielectric block 48 except at clearance portions 53 and 54, an exciting electrode 56 formed on the first side surface of the dielectric block 48, an exciting electrode 57 formed on the second side surface of the dielectric block 48, and a capacitive stub 58 formed on the fourth side surface of the dielectric block 48 continuously at the first to third portions.

As shown in FIGS. 14 and 15, the exciting electrodes 56 and 57 are prevented from being in contact with the metal plate 55 formed on the bottom surface of the dielectric block 48 by the clearance portions 53 and 54, respectively, whereas the capacitive stub 58 is connected to the ground plane 55. One of the exciting electrodes 56 and 57 is used as an input electrode, and the other is used as an output electrode. The capacitive stub 58 is symmetrical with respect to the center of the dielectric block 48 so that a part of the capacitive stub 58 which is formed on the second portion and another part of the capacitive stub 58 which is formed on the third portion have the same dimensions.

The first to third portions of the dielectric block 48 are defined the same as the corresponding portions of the dielectric block 2 of the embodiment explained earlier. The top surface, bottom surface, and first to fourth side surfaces of the dielectric block 48 are defined the same as the corresponding surfaces of the dielectric block 2 of the embodiment explained earlier. Further, the length, width, and thickness are defined the same as the embodiment explained earlier.

According to the above-described structure, the first portion of the dielectric block 48 and the metal plate formed thereon act as an evanescent waveguide 59, the second portion of the dielectric block 48 and the metal plate formed thereon act as a first resonator 60, and the third portion of the dielectric block 48 and the metal plate formed thereon act as a second resonator 61. The evanescent waveguide 59 is an E-mode waveguide, and each of the first and second resonators 60 and 61 is a quarter-wave ($\lambda/4$) dielectric resonator.

The band pass filter 47 having the above-described configuration has the same advantages as the band pass filter 1 of the embodiment described earlier. Specifically, because the mechanical strength of the band pass filter 47 is extremely high compared with conventional filters, even if its overall size is reduced, sufficient mechanical strength can be ensured. In addition, according to this embodiment, because the capacitive stub 58 is formed on the fourth side surface of the dielectric block 48 continuously at the first to third portions, the area of the capacitive stub 58 is large. Thus, the advantages produced by the capacitive stub 58 can be obtained more effectively.

A further preferred embodiment of the present invention will now be explained.

Figure 16:
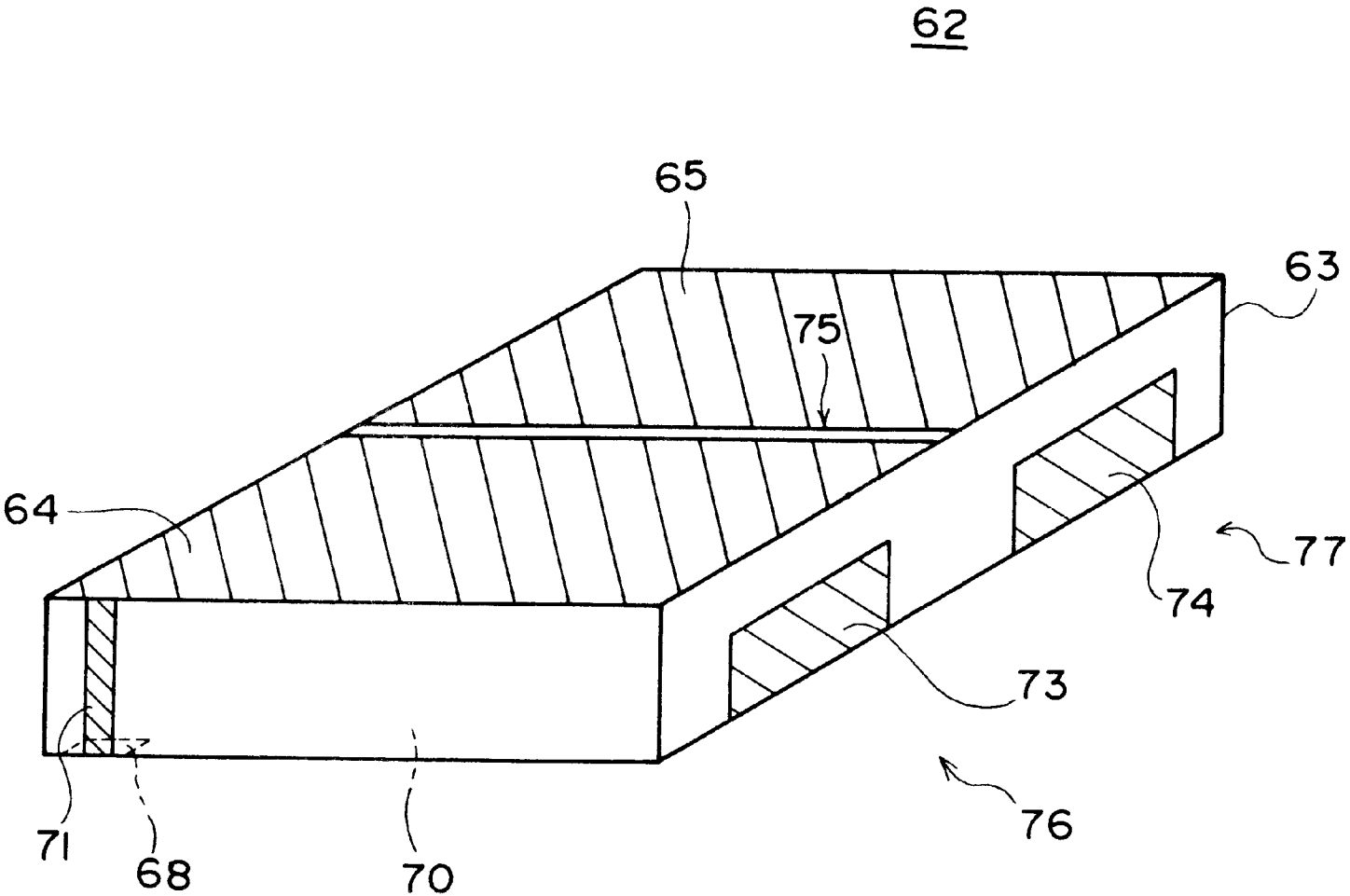
FIG. 16 is a schematic perspective view from one side showing a band pass filter 62 that is a further preferred embodiment of the present invention.
Figure 17:
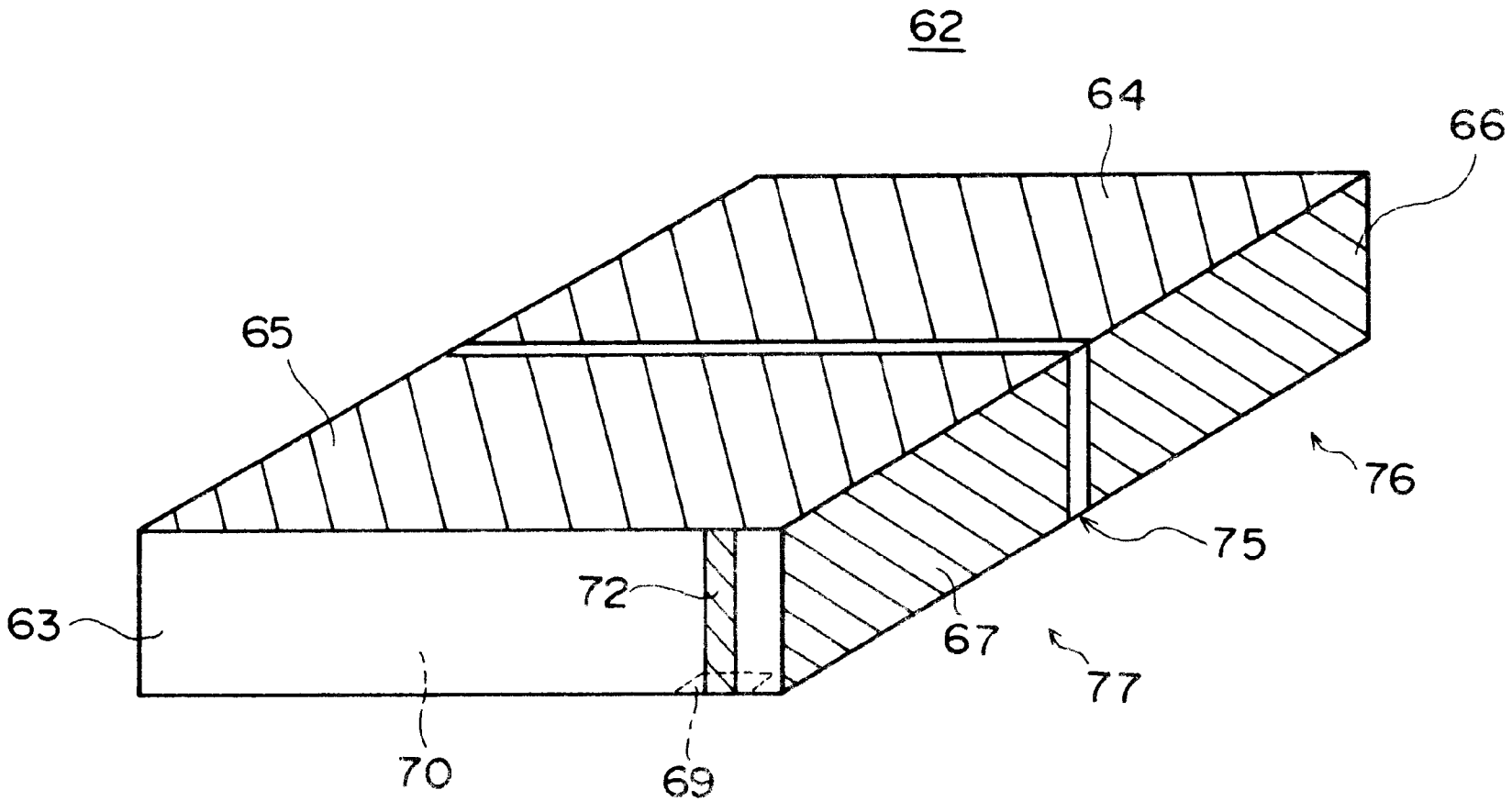
FIG. 17 is a schematic perspective view from the opposite side showing the band pass filter 62 of FIG. 16.

FIG. 16 is a schematic perspective view from one side showing a band pass filter 62 that is a further preferred embodiment of the present invention. FIG. 17 is a schematic perspective view from the opposite side showing the band pass filter 62 of FIG. 16.

As shown in FIGS. 16 and 17, the structure of the band pass filter 62 that is a further preferred embodiment is similar to that of the band pass filter 1 of the embodiment explained earlier. but the band pass filter 62 differs from the band pass filter 1 in that the exciting electrodes are of inductive type.

Specifically, the band pass filter 62 that is a further preferred embodiment is constituted of a rectangular prismatic dielectric block 63 whose dielectric constant $\epsilon\Gamma$ is 93, metal plates 64 and 65 formed on, of the top surface of the dielectric block 63, the entire surfaces corresponding to the second and third portions, respectively, metal plates 66 and 67 formed on, of the third surface of the dielectric block 63, the entire surfaces corresponding to the second and third portions, respectively, a metal plate 70 formed on the bottom surface of the dielectric block 63 except at clearance portions 68 and 69, an exciting electrode 71 formed on the first side surface of the dielectric block 63, an exciting electrode 72 formed on the second side surface of the dielectric block 63, a first capacitive stub 73 formed on the fourth side surface of the dielectric block 63 corresponding to the second portion, and a second capacitive stub 74 formed on the fourth side surface of the dielectric block 63 corresponding to the third portion.

As shown in FIGS. 16 and 17, the exciting electrodes 71 and 72 are connected to the metal plates 64 and 65 formed on the top surface of the dielectric block 63, respectively, while they are prevented from being in contact with the metal plate 70 formed on the bottom surface of the dielectric block 63 by the clearance portions 68 and 69, respectively. The first and second capacitive stubs 73 and 74 are connected to the metal plate 70. As shown in FIGS. 16 and 17, the exciting electrodes 71 and 72 are formed at the first and second side surfaces of the dielectric block 63 where the electric field is relatively weak (the magnetic field is relatively strong). One of the exciting electrodes 71 and 72 is used as an input electrode, and the other is used as an output electrode.

The first to third portions of the dielectric block 63 are defined the same as the corresponding portions of the dielectric block 2 of the embodiment explained earlier. The top surfaces, bottom surfaces, and first to fourth side surfaces of the dielectric block 63 are defined the same as the corresponding surfaces of the dielectric block 2 of the embodiment explained earlier. Further, the length, width, and thickness are defined the same as the embodiment explained earlier.

According to the above described structure, the first portion of the dielectric block 63 and the metal plate formed thereon act as an evanescent waveguide 75, the second portion of the dielectric block 63 and the metal plate formed thereon act as a first resonator 76, and the third portion of the dielectric block 63 and the metal plate formed thereon act as a second resonator 77. The evanescent waveguide 75 is an E-mode waveguide, and each of the first and second resonators 76 and 77 is a quarter-wave ($\lambda/4$) dielectric resonator.

The band pass filter 62 having the above-described configuration has the same advantages as the band pass filter 1 of the embodiment described earlier. Specifically, because the mechanical strength of the band pass filter 62 is extremely high compared with conventional filters, even if its overall size is reduced, sufficient mechanical strength can be ensured.

A further preferred embodiment of the present invention will now be explained.

Figure 18:
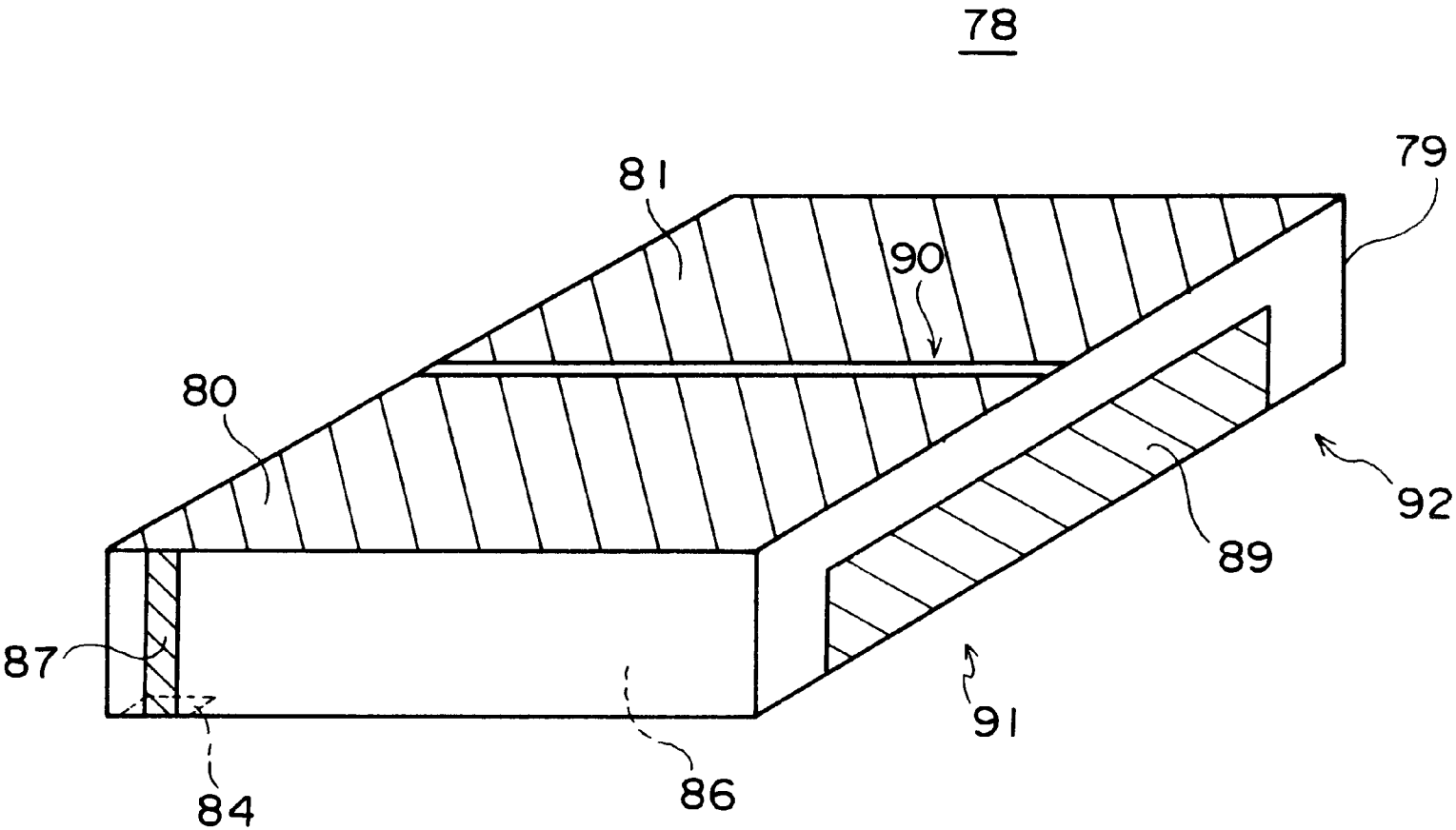
FIG. 18 is a schematic perspective view from one side showing a band pass filter 78 that is a further preferred embodiment of the present invention.
Figure 19:
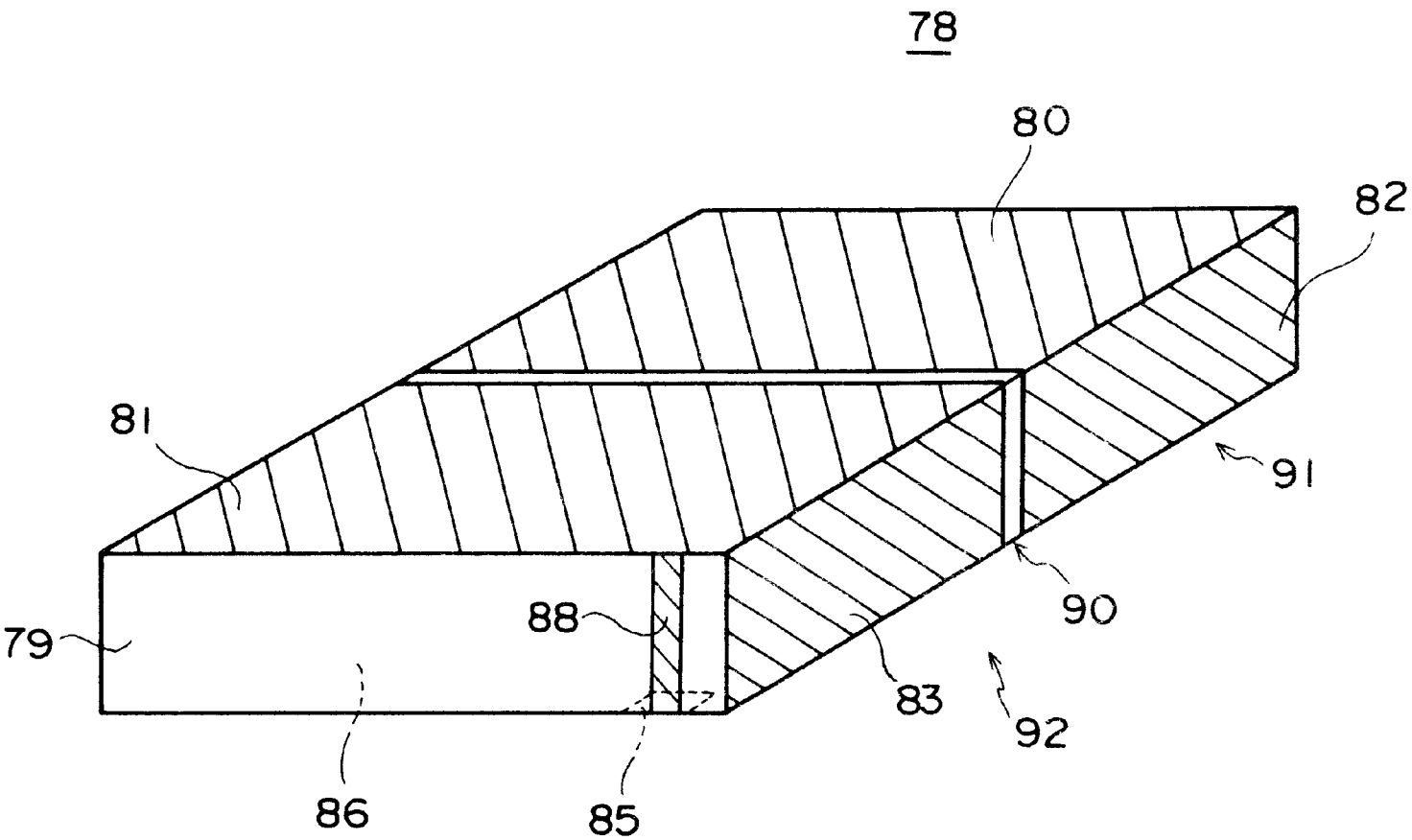
FIG. 19 is a schematic perspective view from the opposite side showing the band pass filter 78 of FIG. 18.

FIG. 18 is a schematic perspective view from one side showing a band pass filter 78 that is a further preferred embodiment of the present invention. FIG. 19 is a schematic perspective view from the opposite side showing the band pass filter 78 of FIG. 18.

As shown in FIGS. 18 and 19, the structure of the band pass filter 78 that is a further preferred embodiment is similar to that of the band pass filter 47 of the embodiment explained earlier, but the band pass filter 78 differs from the band pass filter 47 in that the exciting electrodes are of inductive type.

Specifically, the band pass filter 78 that is a further preferred embodiment is constituted of a rectangular prismatic dielectric block 79 whose dielectric constant $\epsilon\Gamma$ is 93, metal plates 80 and 81 formed on, of the top surface of the dielectric block 79, the entire surfaces corresponding to the second and third portions, respectively, metal plates 82 and 83 formed on, of the third surface of the dielectric block 79, the entire surfaces corresponding to the second and third portions, respectively, a metal plate 86 formed on the bottom surface of the dielectric block 79 except at clearance portions 84 and 85, an exciting electrode 87 formed on the first side surface of the dielectric block 79, an exciting electrode 88 formed on the second side surface of the dielectric block 79, and a capacitive stub 89 formed on the fourth side surface of the dielectric block 79 continuously at the first to third portions.

As shown in FIGS. 18 and 19, the exciting electrodes 87 and 88 are connected to the metal plates 80 and 81 formed on the top surface of the dielectric block 79, respectively, while they are prevented from being in contact with the metal plate 86 formed on the bottom surface of the dielectric block 79 by the clearance portions 84 and 85, respectively. As shown in FIGS. 18 and 19, the exciting electrodes 87 and 88 are formed at the first and second side surfaces of the dielectric block 79 where the electric field is relatively weak (the magnetic field is relatively strong). One of the exciting electrodes 87 and 88 is used as an input electrode, and the other is used as an output electrode. The capacitive stub 89 is symmetrical with respect to the center of the dielectric block 79 so that a part of the capacitive stub 89 which is formed on the second portion and another part of the capacitive stub 89 which is formed on the third portion have the same dimensions.

The first to third portions of the dielectric block 79 are defined the same as the corresponding portions of the dielectric block 2 of the embodiment explained earlier. The top surface, bottom surface, and first to fourth side surfaces of the dielectric block 79 are defined the same as the corresponding surfaces of the dielectric block 2 of the embodiment explained earlier. Further, the length, width, and thickness are defined the same as the embodiment explained earlier.

According to the above described structure, the first portion of the dielectric block 79 and the metal plate formed thereon act as an evanescent waveguide 90, the second portion of the dielectric block 79 and the metal plate formed thereon act as a first resonator 91, and the third portion of the dielectric block 79 and the metal plate formed thereon act as a second resonator 92. The evanescent waveguide 90 is an E-mode waveguide, and each of the first and second resonators 91 and 92 is a quarter-wave ($\lambda/4$) dielectric resonator.

The band pass filter 78 having the above-described configuration has the same advantages as the band pass filter 47 of the embodiment described earlier. Specifically, because the mechanical strength of the band pass filter 78 is extremely high compared with the conventional filters, even if its overall size is reduced, sufficient mechanical strength can be ensured. Moreover, because the capacitive stub 89 is formed on the fourth side surface of the dielectric block 79 continuously at the first to third portions, the area of the capacitive stub 89 is large. Thus, the advantages produced by the capacitive stub 89 can be obtained more effectively.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric block portions for the resonators and the evanescent waveguide are made of dielectric material whose dielectric constant $\epsilon\Gamma$ is 93. However, a material having a different dielectric constant can be used according to purpose.

Further, the dimensions of the resonators and the evanescent waveguide specified in the above-described embodiments are only examples. Resonators and an evanescent waveguide having different dimensions can be used according to purpose.

Figure 20:
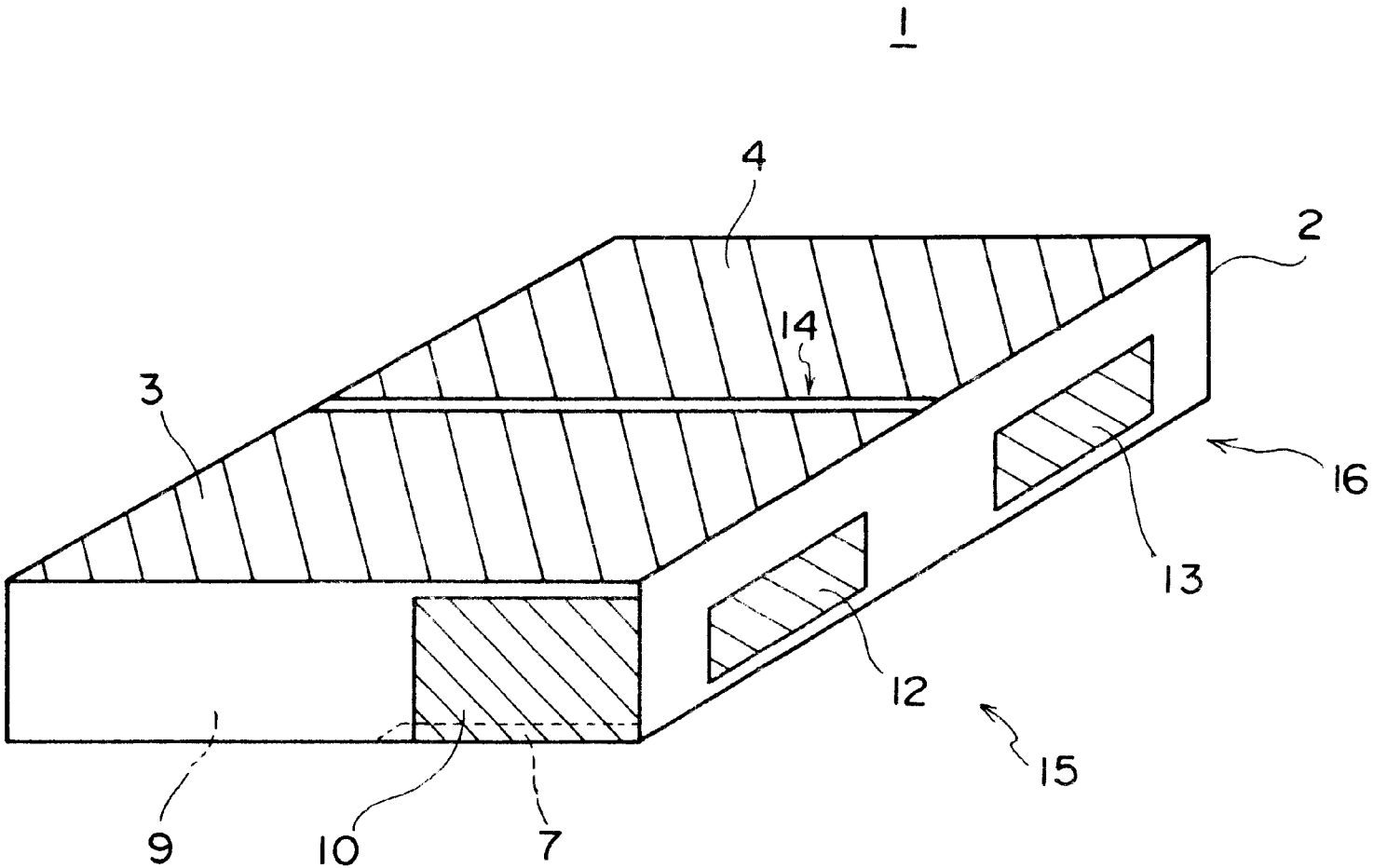
FIG. 20 is a schematic perspective view of the band pass filter 1 showing an example in which the capacitive stubs 12 and 13 and metal plate 9 formed on the bottom surfaces of a dielectric block 2 are separated.
Figure 21:
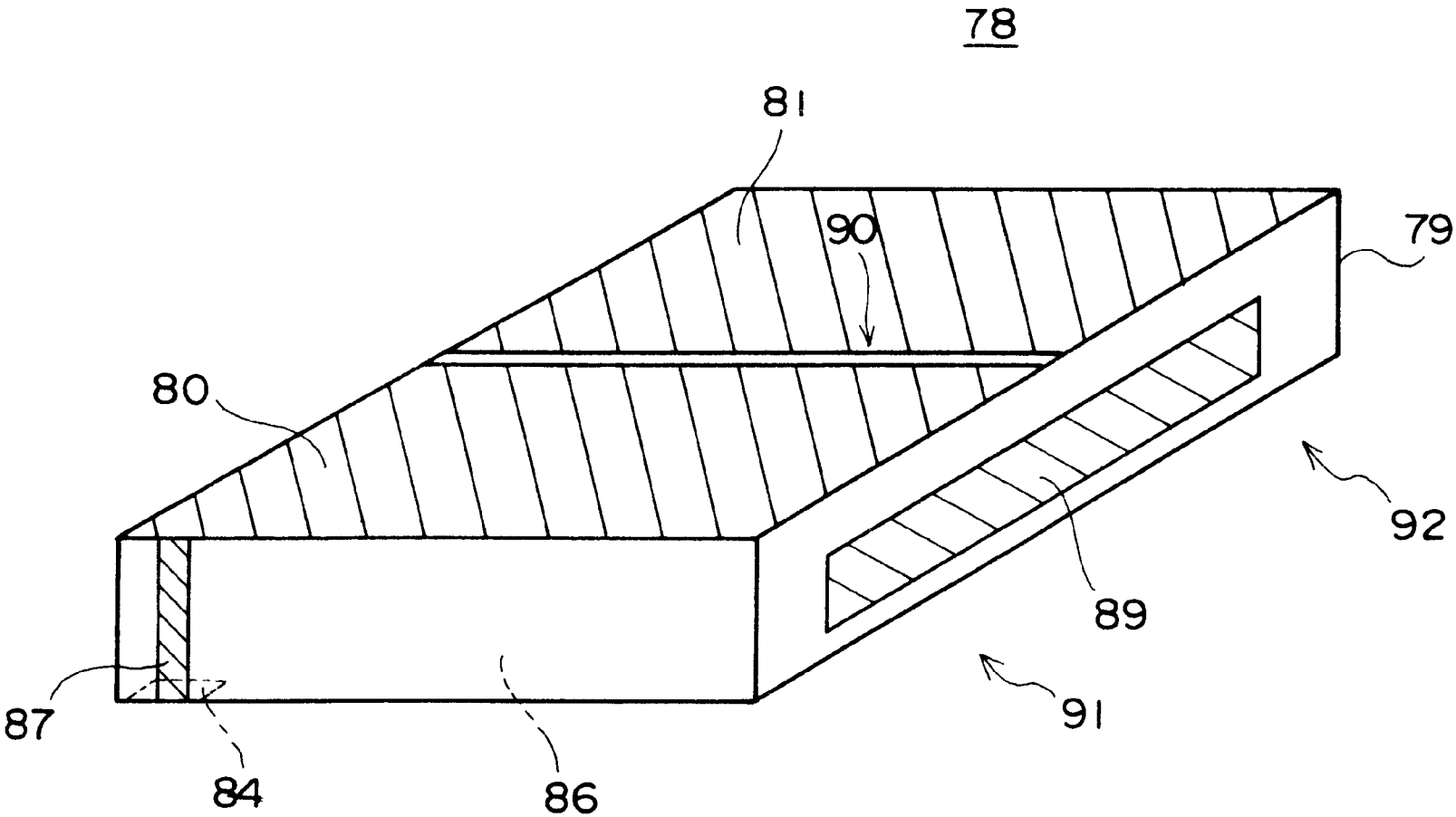
FIG. 21 is a schematic perspective view of the band pass filter 78 showing an example in which a capacitive stub 89 and metal plate 86 formed on the bottom surfaces of a dielectric block 79 are separated.

Further, in the above-described embodiments, the capacitive stubs are formed such that they are in contact with the metal plates formed on the dielectric block. However, the present invention is not limited to the capacitive stubs being in contact with the metal plates and they can be formed separately from the metal plates. An example in which the first and second capacitive stubs 12 and 13 and metal plate 9 are formed separately in the band pass filter 1 is shown in FIG. 20. Another example in which the capacitive stub 89 and metal plate 86 are formed separately in the band pass filter 78 is shown in FIG. 21. This configuration of the capacitive stubs also enables a filter function to be obtained by producing a desired coupling constant $k_{total}$. It is worth noting that to obtain the effects efficiently it is preferable that the capacitive stubs and the metal plates be connected.

As described above, according to the present invention, a highly compact band pass filter of excellent mechanical strength can be provided.

Therefore, the present invention provides a band pass filter that can be preferably utilized in communication terminals such as mobile phones and the like, Wireless LANs (Local Area Networks), and ITS (Intelligent Transport Systems) and the like.

What is claimed is:

1. A band pass filter comprising a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on the surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates including a capacitive stub formed on a first surface of the dielectric block which is substantially perpendicular to the cross-sections.

2. The band pass filter as claimed in claim 1, wherein the capacitive stub is formed on at least surfaces of the second and third portions of the dielectric block.

3. The band pass filter as claimed in claim 2, wherein the capacitive stub is further formed on a surface of the first portion of the dielectric block to form a continuous and integral capacitive stub on the surfaces of the first to third portions of the dielectric block.

4. The band pass filter as claimed in claim 2, wherein a portion of the capacitive stub formed on the surface of the second portion of the dielectric block and another portion of the capacitive stub formed on the surface of the third portion of the dielectric block have the same dimensions.

5. The band pass filter as claimed in claim 1, wherein the metal plates further include a first exciting electrode formed on a second surface of the dielectric block which is substantially parallel to the cross-sections and a second exciting electrode formed on a third surface of the dielectric block which is substantially parallel to the cross-sections.

6. The band pass filter as claimed in claim 1, wherein the second and third portions of the dielectric block have the same dimensions.

7. A band pass filter comprising:

a first flat resonator and a second flat resonator each having top and bottom surfaces on which metal plates are formed, a shorting surface electrically short-circuiting the metal plates formed on the top and bottom surfaces, a first open surface opposite the shorting surface, a second open surface perpendicular to the shorting surface, and a third open surface opposite the second open surface;

an evanescent waveguide provided between the first and second flat resonators such that the evanescent waveguide is in contact with the entire second open surfaces of the first and second flat resonators;

a first capacitive stub formed on the first open surface of the first flat resonator;

a second capacitive stub formed on the first open surface of the second flat resonator;

a first exciting electrode formed on the third open surface of the first flat resonator; and a second exciting electrode formed on the third open surface of the second flat resonator.

8. The band pass filter as claimed in claim 7, wherein the band pass filter is substantially a rectangular prism in overall shape.

9. The band pass filter as claimed in claim 7, wherein the first and second flat resonators have the same dimensions.

10. The band pass filter as claimed in claim 7, wherein the first open surfaces of the first and second flat resonators are coplanar.

11. The band pass filter as claimed in claim 7, wherein the metal plates formed on the bottom surfaces of the first and second flat resonators are short-circuited by a metal plate formed on a bottom surface of the evanescent waveguide.

12. The band pass filter as claimed in claim 7, wherein the first and second capacitive stubs are short-circuited by a metal plate formed on a side surface of the evanescent waveguide.

13. The band pass filter as claimed in claim 7, wherein the first capacitive stub is connected to the metal plate formed on the bottom surface of the first flat resonator and the second capacitive stub is connected to the metal plate formed on the bottom surface of the second flat resonator.

14. The band pass filter as claimed in claim 7, wherein the first exciting electrode is formed on the third open surface of the first flat resonator at a portion adjacent to the first open surface of the first flat resonator, the second exciting electrode is formed on the third open surface of the second flat resonator at a portion adjacent to the first open surface of the second flat resonator, the first exciting electrode is prevented from being in contact with the metal plates formed on the top and bottom surfaces of the first flat resonator, and the second exciting electrode is prevented from being in contact with the metal plates formed on the top and bottom surfaces of the second flat resonator.

15. The band pass filter as claimed in claim 7, wherein the first exciting electrode is formed on the third open surface of the first flat resonator at a portion adjacent to the shorting surface of the first flat resonator, the second exciting electrode is formed on the third open surface of the second flat resonator at a portion adjacent to the shorting surface of the second flat resonator, the first exciting electrode is prevented from being in contact with the metal plate formed on the bottom surface of the first flat resonator and is connected to the metal plate formed on the top surface of the first flat resonator, and the second exciting electrode is prevented from being in contact with the metal plate formed on the bottom surface of the second flat resonator and is connected to the metal plate formed on the top surface of the second flat resonator.

16. A band pass filter comprising:

a first flat resonator and a second flat resonator each having top and bottom surfaces on which metal plates are formed, a shorting surface electrically short-circuiting the metal plates formed on the top and bottom surfaces, a first open surface opposite the shorting surface, a second open surface perpendicular to the shorting surface, and a third open surface opposite the second open surface;

an evanescent waveguide provided between the first and second flat resonators such that the evanescent waveguide is in contact with the entire second open surfaces of the first and second flat resonators;

a first exciting electrode formed on the third open surface of the first flat resonator; and a second exciting electrode formed on the third open surface of the second flat resonator, whereby a first resonation circuit is established between the first exciting electrode and the metal plates, a second resonation circuit is established between the second exciting electrode and the metal plates, and a coupling circuit is established between the first and second resonation circuits, the band pass filter further comprising means for providing an additional capacitance in parallel with the first resonation circuit and another additional capacitance in parallel with the second resonation circuit.

17. The band pass filter as claimed in claim 16, wherein the band pass filter is substantially a rectangular prism in overall shape.

* * * * *